US011181841B2

(12) United States Patent
Iguchi et al.

(10) Patent No.: US 11,181,841 B2
(45) Date of Patent: Nov. 23, 2021

(54) TONER FOR ELECTROSTATIC IMAGE DEVELOPMENT, ELECTROSTATIC IMAGE DEVELOPER, AND TONER CARTRIDGE

(71) Applicant: FUJIFILM Business Innovation Corp., Tokyo (JP)

(72) Inventors: Moegi Iguchi, Kanagawa (JP); Yasuko Torii, Kanagawa (JP); Sakon Takahashi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/841,685

(22) Filed: Apr. 7, 2020

(65) Prior Publication Data

US 2021/0088922 A1 Mar. 25, 2021

(30) Foreign Application Priority Data

Sep. 20, 2019 (JP) ..... JP2019-172163

(51) Int. Cl.

| | |
|---|---|
| ***G03G 9/08*** | (2006.01) |
| ***G03G 9/093*** | (2006.01) |
| ***G03G 21/18*** | (2006.01) |
| ***G03G 9/097*** | (2006.01) |
| ***G03G 15/08*** | (2006.01) |

(52) U.S. Cl.

CPC ..... *G03G 9/09342* (2013.01); *G03G 9/0819* (2013.01); *G03G 9/0821* (2013.01); *G03G 9/09385* (2013.01); *G03G 9/09708* (2013.01); *G03G 9/09725* (2013.01); *G03G 9/09775* (2013.01); *G03G 15/08* (2013.01); *G03G 21/18* (2013.01)

(58) Field of Classification Search

CPC ..... G03G 9/09342; G03G 9/0938; G03G 9/09725; G03G 9/09708

USPC ..... 430/108.3, 108.6, 108.7

See application file for complete search history.

(56) References Cited

U.S. PATENT DOCUMENTS

| | | | |
|---|---|---|---|
| 7,831,176 | B2 | 11/2010 | Ishida |
| 7,899,363 | B2 | 3/2011 | Ishida |
| 10,527,962 | B2 | 1/2020 | Yamagishi et al. |

FOREIGN PATENT DOCUMENTS

| | | |
|---|---|---|
| JP | 2005148405 | 6/2005 |
| JP | 2011203758 | 10/2011 |
| JP | 2018200395 | 12/2018 |
| JP | 2019028235 | 2/2019 |

*Primary Examiner* — Mark A Chapman

(74) *Attorney, Agent, or Firm* — JCIPRNET

(57) ABSTRACT

A toner for electrostatic image development includes: toner particles; Si-doped strontium titanate particles; and silica particles. The particle diameter D of at least one peak in a number-based particle size distribution of primary particles of the silica particles is larger than the number-based median diameter $D_{50}$ of primary particles of the Si-doped strontium titanate particles.

15 Claims, 2 Drawing Sheets

TONER FOR ELECTROSTATIC IMAGE DEVELOPMENT, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2019-172163 filed Sep. 20, 2019.

BACKGROUND

(i) Technical Field

The present disclosure relates to a toner for electrostatic image development, to an electrostatic image developer, and to a toner cartridge.

(ii) Related Art

Japanese Unexamined Patent Application Publication No. 2005-148405 discloses a toner for electrophotography that contains toner base particles, fine strontium titanate particles, fine hydrophobic inorganic particles having an average diameter of from 1/10 to 1/3 of the average diameter of the fine strontium titanate particles.

Japanese Unexamined Patent Application Publication No. 2011-203758 discloses a developer containing, as abrasive particles, strontium titanate particles including primary particles having an average diameter of from 30 nm to 300 nm inclusive.

Japanese Unexamined Patent Application Publication No. 2018-200395 discloses a toner containing toner particles, strontium titanate particles including primary particles having a number average diameter of from 10 nm to 80 nm inclusive, and fumed silica.

Japanese Unexamined Patent Application Publication No. 2019-028235 discloses a toner for electrostatic image development that contains toner particles, silica particles, and strontium titanate particles having an average primary particle diameter of from 10 nm to 100 nm inclusive.

SUMMARY

Aspects of non-limiting embodiments of the present disclosure relate to a toner for electrostatic image development that contains toner particles, Si-doped strontium titanate particles, and silica particles. With this toner for electrostatic image development, the occurrence of fogging is reduced as compared to that with a toner for electrostatic image development in which the particle diameters of all peaks in the number-based particle size distribution of primary particles of the silica particles are smaller than the number-based median diameter $D_{50}$ of primary particles of the Si-doped strontium titanate particles.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a toner for electrostatic image development including: toner particles; Si-doped strontium titanate particles; and silica particles, wherein a particle diameter D of at least one peak in a number-based particle size distribution of primary particles of the silica particles is larger than a number-based median diameter $D_{50}$ of primary particles of the Si-doped strontium titanate particles.

BRIEF DESCRIPTION OF THE DRAWINGS

Exemplary embodiments of the present disclosure will be described in detail based on the following figures, wherein.

DETAILED DESCRIPTION

Figure 1:
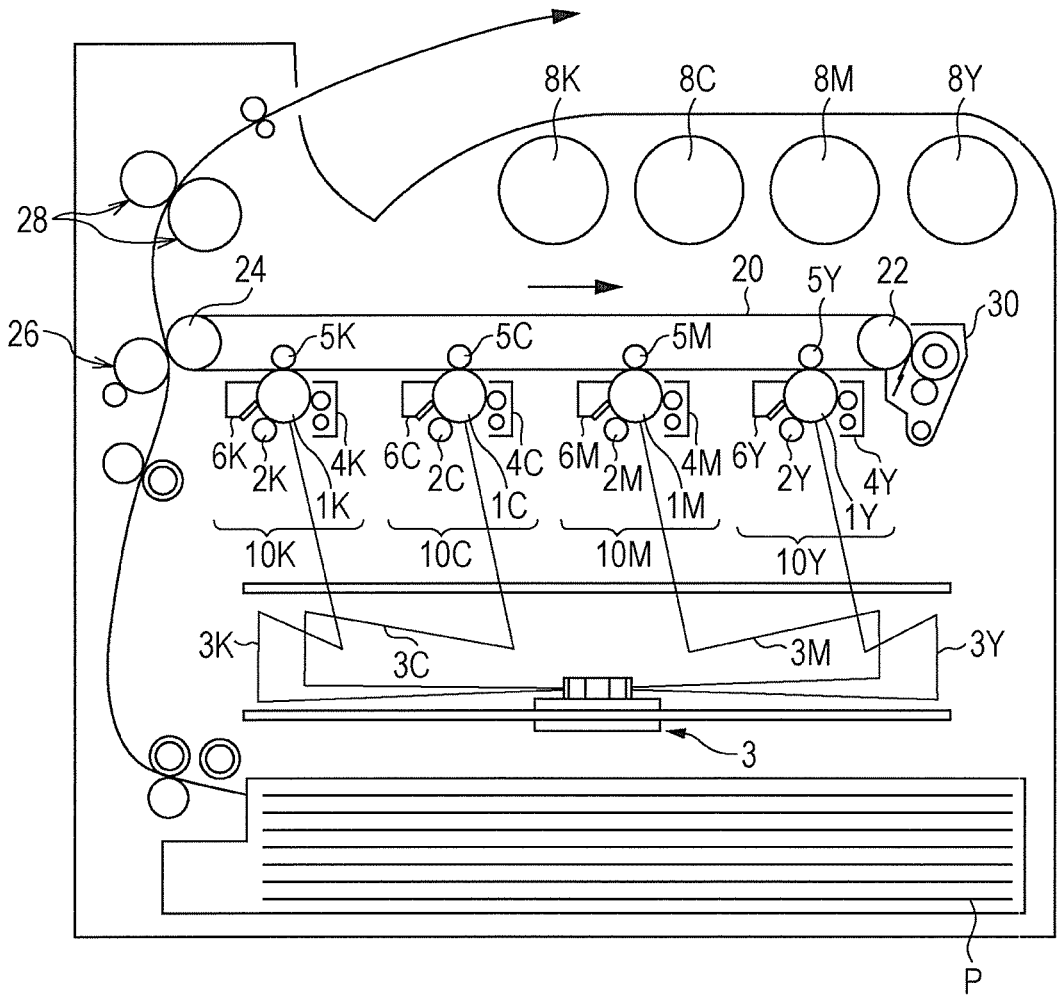
FIG. 1 is a schematic configuration diagram showing an example of an image forming apparatus according to an exemplary embodiment.

Exemplary embodiments of the present disclosure will be described below. The description and Examples are illustrative of the exemplary embodiments and are not intended to limit the scope of the exemplary embodiments.

In the present disclosure, a numerical range represented using "to" means a range including the numerical values before and after the "to" as the minimum value and the maximum value, respectively.

In a set of numerical ranges expressed in a stepwise manner in the present disclosure, the upper or lower limit in one numerical range may be replaced with the upper or lower limit in another numerical range in the set. Moreover, in a numerical range described in the present disclosure, the upper or lower limit in the numerical range may be replaced with a value indicated in an Example.

In the present disclosure, the term "step" is meant to include not only an independent step but also a step that is not clearly distinguished from other steps, so long as the prescribed purpose of the step can be achieved.

In the present disclosure, when an exemplary embodiment is explained with reference to the drawings, the structure of the exemplary embodiment is not limited to the structure shown in the drawings. In the drawings, the sizes of the components are conceptual, and the relative relations between the components are not limited to these relations.

In the present disclosure, any component may contain a plurality of materials corresponding to the component. In the present disclosure, when reference is made to the amount of a component in a composition, if the composition contains a plurality of materials corresponding to the component, the amount means the total amount of the plurality of materials, unless otherwise specified.

In the present disclosure, particles corresponding to a certain component may contain a plurality of types of particles. When a plurality of types of particles corresponding to a certain component are present in a composition, the particle diameter of the component is the value for the mixture of the plurality of types of particles present in the composition, unless otherwise specified.

In the present disclosure, the "toner for electrostatic image development" may be referred to simply as a "toner," and the "electrostatic image developer" may be referred to simply as a "developer."

<Toner for Electrostatic Image Development>

A toner according to an exemplary embodiment contains toner particles, Si-doped strontium titanate particles, and silica particles.

In the silica particles contained in the toner according to the present exemplary embodiment, the particle diameter D of at least one peak in the number-based particle size distribution of primary particles is larger than the number-based median diameter $D_{50}$ of primary particles of the Si-doped strontium titanate particles.

With the toner according to the present exemplary embodiment, the occurrence of fogging is reduced. The "fogging" is a phenomenon in which an unintended dotted image is formed on an image formation surface of a recording medium. The fogging reduction mechanism of the toner according to the present exemplary embodiment may be as follows.

One known external additive for a toner is strontium titanate particles. The strontium titanate particles are externally added as a charge control agent, an abrasive, etc. to the toner.

The present inventors have conducted studies and found the following fact. When a toner with strontium titanate particles added externally thereto is used to form an image, fogging may occur. In particular, fogging is likely to occur when, after low-density images are intermittently formed in a high-temperature/high-humidity environment (for example, at a temperature of 30° C. and a relative humidity of 85%), high-density images are continuously formed in a low-temperature/low-humidity condition (for example, at a temperature of 10° C. and a relative humidity of 15%). This may be because the following phenomenon occurs in developing means.

In a high-temperature/high-humidity environment, the toner particles are relatively soft. In this case, when low-density images that consume the toner at a relatively slow rate are formed continuously, the toner is stirred in the developing means over a long period of time, and the strontium titanate particles are embedded in the toner particles. Then, when high-density images are formed continuously, the toner in the developing means is consumed, and the developing means is replenished with toner, so the toner with the strontium titanate particles embedded therein and the toner with no strontium titanate particles embedded therein are mixed. Specifically, the toners with different surface properties are present in the developing means.

When the toners with different surface properties are rubbed against each other, triboelectrification between the toners, i.e., charge migration from one of the toners to the other toner, occurs (this is likely to occur particularly in a low-temperature/low-humidity environment), so that toner particles with an insufficient charge amount are formed. The toner particles with an insufficient charge amount do not adhere to an image holding member during development but scatter, and fogging thereby occurs.

The present inventors have conducted further studies and found the following fact. When silica particles having a larger diameter than the strontium titanate particles are externally added and the strontium titanate particles are doped with Si (silicon), the occurrence of fogging during the above-described image formation can be reduced.

First, when the silica particles having a relatively large diameter are present on the surfaces of the toner particles, the toner particles are prevented from coming into collision with the strontium titanate particles present on the surfaces of the toner particles, and this may prevent the strontium titanate particles from being embedded in the toner particles.

Moreover, when the strontium titanate particles are doped with Si, the position of the strontium titanate particles in a triboelectric series becomes close to the position of the silica particles, and the toner particles to which the Si-doped strontium titanate particles and the silica particles are externally added may be less likely to undergo triboelectrification than toner particles to which strontium titanate particles not doped with Si and the silica particles are externally added.

Therefore, with the toner according to the present exemplary embodiment, triboelectrification between the toner particles is unlikely to occur even after the image formation described above. In this case, mixing with toner particles with an insufficient charge amount and scattering of the toner are prevented, so that the occurrence of fogging may be reduced.

The diameters of the Si-doped strontium titanate particles and the silica particles contained in the toner according to the present exemplary embodiment are measured by the following method.

The toner is dispersed in methanol, and ultrasonic waves are applied. Then the mixture is subjected to centrifugation to settle the toner particles, and the supernatant containing the external additives is collected. A density gradient solution (e.g., a sodium polytungstate or cesium chloride density gradient solution) is produced in a separate centrifuge tube, and the supernatant is placed on the density gradient solution and subjected to centrifugation. A fraction containing the silica particles and a fraction containing the Si-doped strontium titanate particles that can be identified from their densities are extracted and dried to obtain these particles.

Next, the silica particles (or the Si-doped strontium titanate particles) are added to an aqueous electrolyte solution (an aqueous ISOTON solution), and ultrasonic waves are applied for 30 seconds or longer to disperse the silica particles (or the Si-doped strontium titanate particles) in the form of primary particles. This dispersion is used as a sample, and a laser diffraction scattering particle size distribution analyzer (for example, Microtrac MT3000II manufactured by MicrotracBEL Corp.) is used to measure the diameters of at least 3000 particles. As for the silica particles, a number-based frequency distribution is drawn from the small diameter side, and the particle diameters of peaks are determined. As for the Si-doped strontium titanate particles, a number-based cumulative distribution is drawn from the small diameter side, and a median diameter $D_{50}$ (a particle diameter at which the cumulative percentage is 50%) is determined.

The components, structure, characteristics of the toner according to the present exemplary embodiment will be described in detail.

[Toner Particles]

For example, the toner particles contain a binder resin and optionally contain a coloring agent, a release agent, and additional additives.

Binder Resin

Examples of the binder resin include: vinyl resins composed of homopolymers of monomers such as styrenes (such as styrene, p-chlorostyrene, and α-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene); and vinyl resins composed of copolymers of combinations of two or more of the above monomers.

Other examples of the binder resin include: non-vinyl resins such as epoxy resins, polyester resins, polyurethane resins, polyamide resins, cellulose resins, polyether resins, and modified rosins; mixtures of the non-vinyl resins and the above-described vinyl resins; and graft polymers obtained by polymerizing a vinyl monomer in the presence of any of these resins.

One of these binder resins may be used, or two or more of them may be used in combination.

The binder resin may be a polyester resin.

Examples of the polyester resin include well-known amorphous polyester resins. The polyester resin used may be a combination of an amorphous polyester resin and a crystalline polyester resin. The amount of the crystalline polyester resin used may be from 2% by mass to 40% by mass inclusive (preferably from 2% by mass to 20% by mass inclusive) based on the total mass of the binder resin.

The "crystalline" resin means that, in differential scanning calorimetry (DSC), a clear endothermic peak is observed instead of a stepwise change in the amount of heat absorbed. Specifically, the half width of the endothermic peak when the measurement is performed at a heating rate of 10 (° C./min) is 10° C. or less.

The "amorphous" resin means that the half width exceeds 10° C., that a stepwise change in the amount of heat absorbed is observed, or that a clear endothermic peak is not observed.

Amorphous Polyester Resin

The amorphous polyester resin may be, for example, a polycondensation product of a polycarboxylic acid and a polyhydric alcohol. The amorphous polyester resin used may be a commercial product or a synthesized product.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl (e.g., having 1 to 5 carbon atoms) esters thereof. In particular, the polycarboxylic acid is, for example, preferably an aromatic dicarboxylic acid.

The polycarboxylic acid used may be a combination of a dicarboxylic acid and a tricarboxylic or higher polycarboxylic acid having a crosslinked or branched structure. Examples of the tricarboxylic or higher polycarboxylic acid include trimellitic acid, pyromellitic acid, anhydrides thereof, and lower alkyl (e.g., having 1 to 5 carbon atoms) esters thereof.

Any of these polycarboxylic acids may be used alone or in combination of two or more.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). In particular, the polyhydric alcohol is, for example, preferably an aromatic diol or an alicyclic diol and more preferably an aromatic diol.

The polyhydric alcohol used may be a combination of a diol and a trihydric or higher polyhydric alcohol having a crosslinked or branched structure. Examples of the trihydric or higher polyhydric alcohol include glycerin, trimethylolpropane, and pentaerythritol.

Any of these polyhydric alcohols may be used alone or in combination or two or more.

The glass transition temperature (Tg) of the amorphous polyester resin is preferably from 50° C. to 80° C. inclusive and more preferably from 50° C. to 65° C. inclusive.

The glass transition temperature is determined using a DSC curve obtained by differential scanning calorimetry (DSC). More specifically, the glass transition temperature is determined from "extrapolated glass transition onset temperature" described in a glass transition temperature determination method in "Testing methods for transition temperatures of plastics" in JIS K7121:1987.

The weight average molecular weight (Mw) of the amorphous polyester resin is preferably from 5000 to 1000000 inclusive and more preferably from 7000 to 500000 inclusive.

The number average molecular weight (Mn) of the amorphous polyester resin may be from 2000 to 100000 inclusive.

The molecular weight distribution Mw/Mn of the amorphous polyester resin is preferably from 1.5 to 100 inclusive and more preferably from 2 to 60 inclusive.

The weight average molecular weight and the number average molecular weight are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The amorphous polyester resin can be obtained by a well-known production method. For example, in one production method, the polymerization temperature is set to from 180° C. to 230° C. inclusive. If necessary, the pressure of the reaction system is reduced, and the reaction is allowed to proceed while water and alcohol generated during condensation are removed.

When raw material monomers are not dissolved or not compatible with each other at the reaction temperature, a high-boiling point solvent serving as a solubilizer may be added to dissolve the monomers. In this case, the polycondensation reaction is performed while the solubilizer is removed by evaporation. When a monomer with poor compatibility is present in the copolymerization reaction, the monomer with poor compatibility and an acid or an alcohol to be polycondensed with the monomer are condensed in advance and then the resulting polycondensation product and the rest of the components are subjected to polycondensation.

Crystalline Polyester Resin

The crystalline polyester resin is, for example, a polycondensation product of a polycarboxylic acid and a polyhydric alcohol. The crystalline polyester resin used may be a commercial product or a synthesized product.

The crystalline polyester resin is preferably a polycondensation product using a polymerizable linear aliphatic monomer rather than using a polymerizable monomer having an aromatic ring, in order to facilitate the formation of a crystalline structure.

Examples of the polycarboxylic acid include aliphatic dicarboxylic acids (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (such as dibasic acids such as phthalic acid, isophthalic acid, terephthalic acid, and naphthalene-2,6-dicarboxylic acid), anhydrides thereof, and lower alkyl (e.g., having 1 to 5 carbon atoms) esters thereof.

The polycarboxylic acid used may be a combination of a dicarboxylic acid and a tricarboxylic or higher polycarboxylic acid having a crosslinked or branched structure. Examples of the tricarboxylic acid include aromatic carboxylic acids (such as 1,2,3-benzenetricarboxylic acid, 1,2,4-benzenetricarboxylic acid, and 1,2,4-naphthalene tricarboxylic acid), anhydrides thereof, and lower alkyl (e.g., having 1 to 5 carbon atoms) esters thereof.

The polycarboxylic acid used may be a combination of a dicarboxylic acid, a dicarboxylic acid having a sulfonic acid group, and a dicarboxylic acid having an ethylenic double bond.

Any of these polycarboxylic acids may be used alone or in combination of two or more.

The polyhydric alcohol may be, for example, an aliphatic diol (e.g., a linear aliphatic diol with a main chain having 7 to 20 carbon atoms). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. In particular, the aliphatic diol is preferably 1,8-octanediol, 1,9-nonanediol, or 1,10-decanediol.

The polyhydric alcohol used may be a combination of a diol and a trihydric or higher polyhydric alcohol having a crosslinked or branched structure. Examples of the trihydric or higher polyhydric alcohol include glycerin, trimethylolethane, trimethylolpropane, and pentaerythritol.

Any of these polyhydric alcohols may be used alone or in combination of two or more.

In the polyhydric alcohol, the content of the aliphatic diol may be 80% by mole or more and preferably 90% by mole or more.

The melting temperature of the crystalline polyester resin is preferably from 50° C. to 100° C. inclusive, more preferably from 55° C. to 90° C. inclusive, and still more preferably from 60° C. to 85° C. inclusive.

The melting temperature is determined using a DSC curve obtained by differential scanning calorimetry (DSC) from "peak melting temperature" described in a melting temperature determination method in "Testing methods for transition temperatures of plastics" in JIS K7121:1987.

The weight average molecular weight (Mw) of the crystalline polyester resin may be from 6000 to 35000 inclusive.

Like the amorphous polyester, the crystalline polyester resin is obtained by a well-known production method.

The content of the binder resin is preferably from 40% by mass to 95% by mass inclusive, more preferably from 50% by mass to 90% by mass inclusive, and still more preferably from 60% by mass to 85% by mass inclusive based on the total mass of the toner particles.

Coloring Agent

Examples of the coloring agent include: pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

One coloring agent may be used alone, or two or more coloring agents may be used in combination.

The coloring agent used may be optionally subjected to surface treatment or may be used in combination with a dispersant. A plurality of coloring agents may be used in combination.

The content of the coloring agent is preferably from 1% by mass to 30% by mass inclusive and more preferably from 3% by mass to 15% by mass inclusive based on the total mass of the toner particles.

Release Agent

Examples of the release agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters. However, the release agent is not limited to these waxes.

The melting temperature of the release agent is preferably from 50° C. to 110° C. inclusive and more preferably from 60° C. to 100° C. inclusive.

The melting temperature is determined using a DSC curve obtained by differential scanning calorimetry (DSC) from "peak melting temperature" described in a melting temperature determination method in "Testing methods for transition temperatures of plastics" in JIS K7121:1987.

The content of the release agent is preferably from 1% by mass to 20% by mass inclusive and more preferably from 5% by mass to 15% by mass inclusive based on the total mass of the toner particles.

Additional Additives

Examples of the additional additives include well-known additives such as a magnetic material, a charge control agent, and an inorganic powder. These additives are contained in the toner particles as internal additives.

Characteristics Etc. of Toner Particles

The toner particles may have a single layer structure or may have a so-called core-shell structure including a core (core particle) and a coating layer (shell layer) covering the core.

Toner particles having the core-shell structure may each include, for example: a core containing a binder resin and optional additives such as a coloring agent and a release agent; and a coating layer containing a binder resin.

The volume average particle diameter (D50v) of the toner particles is preferably from 2 μm to 10 μm inclusive and more preferably from 4 μm to 8 μm inclusive.

The volume average particle diameter (D50v) of the toner particles is measured using Coulter Multisizer II (manufactured by Beckman Coulter, Inc.), and ISOTON-II (manufactured by Beckman Coulter, Inc.) is used as an electrolyte.

In the measurement, 0.5 mg to 50 mg of a measurement sample is added to 2 mL of a 5% by mass aqueous solution of a surfactant (which may be sodium alkylbenzenesulfonate) serving as a dispersant. The mixture is added to 100 mL to 150 mL of the electrolyte.

The electrolyte with the sample suspended therein is subjected to dispersion treatment for 1 minute using an ultrasonic dispersion apparatus, and then the particle size distribution of particles having diameters within the range of 2 μm to 60 μm is measured using an aperture having an aperture diameter of 100 μm in the Coulter Multisizer II. The number of particles sampled is 50000. A volume-based particle size distribution is drawn from the small diameter side, and the particle diameter at a cumulative percentage of 50% is used as the volume average particle diameter D50v.

The average circularity of the toner particles is preferably from 0.94 to 1.00 inclusive and more preferably from 0.95 to 0.98 inclusive.

The circularity of a toner particle is determined as (the peripheral length of an equivalent circle of the toner particle)/(the peripheral length of the toner particle) (i.e., the peripheral length of a circle having the same area as a projection image of the particle/the peripheral length of the projection image of the particle). Specifically, the average circularity is a value measured by the following method.

First, the toner particles used for the measurement are collected by suction, and a flattened flow of the particles is formed. Particle images are captured as still images using flashes of light, and the average circularity is determined by subjecting the particle images to image analysis using a flow-type particle image analyzer (FPIA-3000 manufactured by SYSMEX Corporation). The number of sampled particles for determination of the average circularity is 3,500.

When the toner contains the external additives, the toner (developer) for the measurement is dispersed in water containing a surfactant, and the dispersion is subjected to ultrasonic treatment. The toner particles with the external additives removed are thereby obtained.

[Si-Doped Strontium Titanate Particles]

In the present disclosure, the median diameter $D_{50}$ of the Si-doped strontium titanate particles is the number-based median diameter $D_{50}$ of their primary particles.

The Si-doped strontium titanate particles are strontium titanate particles doped with at least Si and may be doped with Si and an element other than Si, Sr, Ti, and O (e.g., a metal element other than Si, Sr, and Ti). One type of Si-doped strontium titanate particles may be used alone, or two or more types may be used in combination.

The molar amount of Si contained in the Si-doped strontium titanate particles may be from 0.25 mol % to 10 mol % inclusive based on the molar amount of Sr. The molar amount of Si based on the molar amount of Sr contained in the Si-doped strontium titanate particles is referred to also as a "Si doping amount." The Si doping amount of the Si-doped strontium titanate particles can be determined by fluorescence X-ray analysis.

From the viewpoint of bringing the position of the Si-doped strontium titanate particles in the triboelectric series close to the position of the silica particles, the Si doping amount of the Si-doped strontium titanate particles is preferably 0.25 mol % or more, more preferably 0.5 mol % or more, and still more preferably 1 mol % or more.

The strontium titanate particles generally have a cubic or cuboidal particle shape. However, when the strontium titanate particles are doped with Si, the degree of crystallinity of strontium titanate is reduced, and the strontium titanate particles have a rounded particle shape, so that the strontium titanate particles may be less likely to be embedded in the toner particles. From this point of view also, it is preferable that the Si doping amount falls within the above range.

From the viewpoint of obtaining a desired particle diameter by growing crystals during production of the Si-doped strontium titanate particles and from the viewpoint of allowing the Si-doped strontium titanate particles to have the effect of controlling electrification, the Si doping amount of the Si-doped strontium titanate particles is preferably 10 mol % or less, more preferably 7 mol % or less, and still more preferably 5 mol % or less.

From the viewpoint of preventing the Si-doped strontium titanate particles from being embedded in the toner particles, the median diameter $D_{50}$ of the Si-doped strontium titanate particles is preferably 30 nm or more and more preferably 35 nm or more. From the viewpoint of covering the surfaces of the toner particles to some extent with a relatively small amount of the Si-doped strontium titanate particles externally added, the median diameter $D_{50}$ of the Si-doped strontium titanate particles is preferably 80 nm or less, more preferably 70 nm or less, and still more preferably 60 nm or less.

The amount of the Si-doped strontium titanate particles externally added is preferably from 0.3 parts by mass to 5 parts by mass inclusive, more preferably from 0.5 parts by mass to 3 parts by mass inclusive, and still more preferably from 0.5 parts by mass to 2 parts by mass inclusive based on 100 parts by mass of the toner particles.

Method for Producing Si-Doped Strontium Titanate Particles

The Si-doped strontium titanate particles may be untreated Si-doped strontium titanate particles or Si-doped strontium titanate particles with their surfaces subjected to hydrophobic treatment. No particular limitation is imposed on the method for producing the Si-doped strontium titanate particles. From the viewpoint of controlling the particle diameter, a wet production method may be used.

Production of Si-Doped Strontium Titanate Particles

The wet production method for the Si-doped strontium titanate particles is a production method including, for example: allowing a solution mixture of a titanium oxide source, a strontium source, and a dopant source to react while an alkaline aqueous solution is added to the mixture; and subjecting the reaction mixture to acid treatment. In this production method, the diameter of the Si-doped strontium titanate particles is controlled by changing the mixing ratio of the strontium source to the titanium oxide source, the concentration of the titanium oxide source at the beginning of the reaction, the temperature when the alkaline aqueous solution is added, the addition rate of the alkaline aqueous solution, etc.

The titanium oxide source may be a peptized product prepared by peptizing a hydrolysate of a titanium compound with a mineral acid. Examples of the strontium source include strontium nitrate and strontium chloride.

As for the mixing ratio of the strontium source to the titanium oxide source, the molar ratio Sr/Ti is preferably from 0.9 to 1.4 inclusive and more preferably from 1.05 to 1.20 inclusive. As for the concentration of the titanium oxide source at the beginning of the reaction, the concentration of $TiO_2$ is preferably from 0.05 mol/L to 1.3 mol/L inclusive and more preferably from 0.5 mol/L to 1.0 mol/L inclusive.

Examples of the dopant source include Si oxides (e.g., silicon dioxide). The Si oxide used as the dopant source is added as a solution obtained by dissolving the Si oxide in, for example, nitric acid, hydrochloric acid, or sulfuric acid. As for the amount of the dopant source added, the amount of Si contained in the dopant source with respect to 100 moles of strontium contained in the strontium source is preferably from 0.25 moles to 10 moles inclusive, more preferably from 0.5 moles to 7 moles inclusive, and still more preferably from 1 mole to 5 moles inclusive.

The alkaline aqueous solution may be an aqueous sodium hydroxide solution. The higher the temperature of the reaction solution when the alkaline aqueous solution is added, the higher the crystallinity of the particles obtained. The temperature of the reaction solution when the alkaline aqueous solution is added is, for example, in the range of from 60° C. to 100° C. inclusive. The lower the rate of addition of the alkaline aqueous solution, the larger the diameter of the particles obtained. The higher the rate of addition, the smaller the diameter of the particles. The rate of addition of the alkaline aqueous solution to the raw materials is, for example, preferably from 0.001 equivalents/h to 1.2 equivalents/h inclusive and more preferably from 0.002 equivalents/h to 1.1 equivalents/h inclusive.

After the addition of the alkaline aqueous solution, the acid treatment is performed for the purpose of removing an unreacted portion of the strontium source. The acid treatment is performed using, for example, hydrochloric acid to adjust the pH of the reaction solution to 2.5 to 7.0 and more preferably 4.5 to 6.0. After the acid treatment, the reaction solution is subjected to solid-liquid separation, and the solid is dried to thereby obtain the Si-doped strontium titanate particles.

Surface Treatment

The Si-doped strontium titanate particles are subjected to surface treatment, for example, in the following manner. A silicon-containing organic compound serving as a hydrophobic treatment agent and a solvent are mixed to prepare a treatment solution. Then the Si-doped strontium titanate particles and the treatment solution are mixed under stirring, and then the stirring is continued. After the surface treatment, drying treatment is performed for the purpose of removing the solvent in the treatment solution.

Examples of the silicon-containing organic compound used for the surface treatment of the Si-doped strontium titanate particles include alkoxysilane compounds, silazane compounds, and silicone oils.

Examples of the alkoxysilane compound used for the surface treatment of the Si-doped strontium titanate particles include tetramethoxysilane, tetraethoxysilane, methyltrimethoxysilane, ethyltrimethoxysilane, propyltrimethoxysilane, butyltrimethoxysilane, hexyltrimethoxysilane, n-octyltrimethoxysilane, decyltrimethoxysilane, dodecyltrimethoxysilane, vinyltriethoxysilane, methyltriethoxysilane, ethyltriethoxysilane, butyltriethoxysilane, hexyltriethoxysilane, decyltriethoxysilane, dodecyltriethoxysilane, phenyltrimethoxysilane, o-methylphenyltrimethoxysilane, p-methylphenyltrimethoxysilane, phenyltriethoxysilane, benzyltriethoxysilane, dimethyldimethoxysilane, dimethyldiethoxysilane, methylvinyldimethoxysilane, methylvinyldiethoxysilane, diphenyldimethoxysilane, diphenyldiethoxysilane, trimethylmethoxysilane, and trimethylethoxysilane.

Examples of the silazane compound used for the surface treatment of the Si-doped strontium titanate particles include dimethyldisilazane, trimethyldisilazane, tetramethyldisilazane, pentamethyldisilazane, and hexamethyldisilazane.

Examples of the silicone oil used for the surface treatment of the Si-doped strontium titanate particles include: silicone oils such as dimethylpolysiloxane, diphenylpolysiloxane, and phenylmethylpolysiloxane; and reactive silicone oils such as amino-modified polysiloxanes, epoxy-modified polysiloxanes, carboxyl-modified polysiloxanes, carbinol-modified polysiloxanes, fluorine-modified polysiloxanes, methacrylic-modified polysiloxanes, mercapto-modified polysiloxanes, and phenol-modified polysiloxanes.

When the silicon-containing organic compound is the alkoxysilane compound or the silazane compound, the solvent used to prepare the treatment solution may be an alcohol (such as methanol, ethanol, propanol, or butanol). When the silicon-containing organic compound is the silicone oil, the solvent may be a hydrocarbon (such as benzene, toluene, n-hexane, or n-heptane).

In the treatment solution, the concentration of the silicon-containing organic compound is preferably from 1% by mass to 50% by mass inclusive, more preferably from 5% by mass to 40% by mass inclusive, and still more preferably from 10% by mass to 30% by mass inclusive.

The amount of the silicon-containing organic compound used for the surface treatment is preferably from 1 part by mass to 50 parts by mass inclusive, more preferably from 5 parts by mass to 40 parts by mass inclusive, and still more preferably from 5 parts by mass to 30 parts by mass inclusive based on 100 parts by mass of the Si-doped strontium titanate particles.

[Silica Particles]

In the present disclosure, the particle size distribution of the silica particles is the number-based particle size distribution of their primary particles.

The particle size distribution of the silica particles externally added to the toner according to the present exemplary embodiment may be unimodal or may be multimodal. However, the particle diameter D of at least one peak in the particle size distribution is larger than the median diameter $D_{50}$ of the Si-doped strontium titanate particles.

In example (1) of the silica particles in the present exemplary embodiment, the particle size distribution is unimodal, and the particle diameter of the peak is larger than the median diameter $D_{50}$ of the Si-doped strontium titanate particles.

In example (2) of the silica particles in the present exemplary embodiment, the particle size distribution is bimodal. The particle diameter of the large diameter-side peak is larger than the median diameter $D_{50}$ of the Si-doped strontium titanate particles, and the particle diameter of the small diameter-side peak is equal to or smaller than the median diameter $D_{50}$ of the Si-doped strontium titanate particles. From the viewpoint of further reducing the occurrence of fogging, the amount of silica particles forming the large diameter-side peak may be larger (in terms of mass) than the amount of silica particles forming the small diameter-side peak.

In example (3) of the silica particles in the present exemplary embodiment, the particle size distribution is bimodal. Both the particle diameter of the large diameter-side peak and the particle diameter of the small diameter-side peak are larger than the median diameter $D_{50}$ of the Si-doped strontium titanate particles. From the viewpoint of further reducing the occurrence of fogging, the amount of silica particles forming the small diameter-side peak is larger (in terms of mass) than the amount of silica particles forming the large diameter-side peak.

In example (4) of the silica particles in the present exemplary embodiment, the particle size distribution is trimodal. The particle diameter of the large diameter-side peak and the particle diameter of the intermediate peak are larger than the median diameter $D_{50}$ of the Si-doped strontium titanate particles, and the particle diameter of the small diameter-side peak is equal to or smaller than the median diameter $D_{50}$ of the Si-doped strontium titanate particles. From the viewpoint of further reducing the occurrence of fogging, the amount of silica particles forming the intermediate peak may be larger (in terms of mass) than the amount of silica particles forming the large diameter-side peak and the amount of silica particles forming the small diameter-side peak.

When the particle size distribution of the silica particles is unimodal, the distribution may be narrow or may be wide.

When the particle size distribution of the silica particles is multimodal, each peak may be narrow or may be wide.

From the viewpoint of further reducing the occurrence of fogging, the particle size distribution of the silica particles may be a narrow unimodal distribution or a multimodal (bimodal or trimodal) distribution with narrow peaks.

In the present disclosure, the term "narrow peak" in the silica particle distribution means that the coefficient of variation of the distribution (a value obtained by dividing the standard deviation by the average) is 20% or less.

Specific examples of the silica particles include silica particles prepared by a vapor phase method, silica particles prepared by a wet method, and fused silica particles. From the viewpoint of obtaining a narrow particle size distribution and from the viewpoint of obtaining water content within an appropriate range, the silica particles may be sol-gel silica particles. The sol-gel silica particles generally have a narrow particle size distribution, and the coefficient of variation of the particle size distribution (a value obtained by dividing the standard deviation by the average) of the sol-gel silica particles in one production lot is 15% or less.

The sol-gel method for producing the silica particles is well-known. For example, the sol-gel method includes: adding ammonia water dropwise to a solution mixture of tetraalkoxysilane, water, and alcohol to prepare a silica sol suspension; separating a wet silica gel from the silica sol suspension by centrifugation; and drying the wet silica gel to obtain silica particles. Examples of the tetraalkoxysilane include tetramethoxysilane, tetraethoxysilane, tetrapropoxysilane, and tetrabutoxysilane.

When the silica particles are produced, for example, by the sol-gel method, the diameter of the primary particles of the silica particles can be controlled by changing the stirring speed when the silica sol suspension is prepared or the time required for the preparation of the silica sol suspension. The higher the stirring speed when the silica sol suspension is prepared, the smaller the particle diameter of the primary particles of the silica particles. The longer the time required for the preparation of the silica sol suspension, the larger the particle diameter of the primary particles of the silica particles.

The surfaces of the silica particles may be subjected to hydrophobic treatment. The hydrophobic treatment is performed, for example, by immersing the silica particles in a hydrophobic treatment agent. No particular limitation is imposed on the hydrophobic treatment agent. Examples of the hydrophobic treatment agent include alkoxysilane compounds, silazane compounds (such as 1,1,1,3,3,3-hexamethyldisilazane), silicone oils (such as dimethyl silicone oil), titanate-based coupling agents, and aluminum-based coupling agents. These may be used alone or in combination of two or more. The amount of the hydrophobic treatment agent is generally, for example, from 1 part by mass to 10 parts by mass inclusive based on 100 parts by mass of the silica particles.

From the viewpoint of further reducing the occurrence of fogging, the particle diameter D of at least one peak in the particle size distribution of the silica particles is larger than the median diameter $D_{50}$ of the Si-doped strontium titanate particles and is preferably from 40 nm to 120 nm inclusive, more preferably from 50 nm to 110 nm inclusive, and still more preferably from 60 nm to 110 nm inclusive.

In example (2) in the present exemplary embodiment, the particle diameter of the large diameter-side peak may be within the above range. In example (3) in the present exemplary embodiment, the particle diameter of the small diameter-side peak may be within the above range. In example (4) in the present exemplary embodiment, the particle diameter of the intermediate peak may be within the above range.

The particle diameter D of at least one peak in the particle size distribution of the silica particles and the median diameter $D_{50}$ of the Si-doped strontium titanate particles satisfy preferably the relation $10\ nm \leq D-D_{50} \leq 100\ nm$, more preferably the relation $20\ nm \leq D-D_{50} \leq 90\ nm$, and still more preferably the relation $20\ nm \leq D-D_{50} \leq 80\ nm$. When any of these relation is satisfied, the occurrence of fogging is further reduced.

In example (2) in the present exemplary embodiment, the particle diameter of the large diameter-side peak may satisfy any of the these relations. In example (3) in the present exemplary embodiment, the particle diameter of the small diameter-side peak may satisfy any of the these relations. In example (4) in the present exemplary embodiment, the particle diameter of the intermediate peak may satisfy any of the these relations.

From the viewpoint of further reducing the occurrence of fogging, the silica particles may include sol-gel silica particles, and the particle diameter D of at least one peak formed by the sol-gel silica particles in the particle size distribution may be larger than the median diameter $D_{50}$ of the Si-doped strontium titanate particles and is preferably from 40 nm to 120 nm inclusive, more preferably from 50 nm to 110 nm inclusive, and still more preferably from 60 nm to 110 nm inclusive.

In example (2) in the present exemplary embodiment, the sol-gel silica particles may form at least the large diameter-side peak, and the particle diameter of the large diameter-side peak may fall within the above range. In example (3) in the present exemplary embodiment, the sol-gel silica particles may form at least the small diameter-side peak, and the particle diameter of the small diameter-side peak may fall within the above range. In example (4) in the present exemplary embodiment, the sol-gel silica particles may form at least the intermediate peak, and the particle diameter of the intermediate peak may fall within the above range.

The sol-gel silica particles having a particle diameter falling within the above range are preferably sol-gel silica particles subjected to hydrophobic treatment and more preferably sol-gel silica particles subjected to hydrophobic treatment with a silazane compound (preferably 1,1,1,3,3,3-hexamethyldisilazane).

From the viewpoint of further reducing the occurrence of fogging, the silica particles may include sol-gel silica particles, and the particle diameter D of at least one peak formed by the sol-gel silica particles in the particle size distribution of the silica particles and the median diameter $D_{50}$ of the Si-doped strontium titanate particles satisfy preferably the relation $10\ nm \leq D-D_{50} \leq 100\ nm$, more preferably the relation $20\ nm \leq D-D_{50} \leq 90\ nm$, and still more preferably the relation $20\ nm \leq D-D_{50} \leq 80\ nm$.

In example (2) in the present exemplary embodiment, the sol-gel silica particles may form at least the large diameter-side peak, and the particle diameter of the large diameter-side peak may satisfy any of the above relations. In example (3) in the present exemplary embodiment, the sol-gel silica particles may form at least the small diameter-side peak, and the particle diameter of the small diameter-side peak may satisfy any of the above relations. In example (4) in the present exemplary embodiment, the sol-gel silica particles may form at least the intermediate peak, and the particle diameter of the intermediate peak may satisfy any of the above relations.

The sol-gel silica particles satisfying any of the above relations are preferably sol-gel silica particles subjected to hydrophobic treatment and more preferably sol-gel silica particles subjected to hydrophobic treatment with a silazane compound (preferably 1,1,1,3,3,3-hexamethyldisilazane).

From the viewpoint of further reducing the occurrence of fogging, the water content of sol-gel silica particles (including sol-gel silica particles subjected to hydrophobic treatment) having diameters larger than the median diameter $D_{50}$ of the Si-doped strontium titanate particles is preferably from 1% by mass to 10% by mass inclusive, more preferably from 2% by mass to 8% by mass inclusive, and still more preferably from 3% by mass to 6% by mass inclusive.

The water content of the sol-gel silica particles is measured as follows.

A specimen is placed in a chamber at a temperature of 22° C. and a relative humidity of 55% and left to stand for 20 hours or longer to subject the specimen to humidity control. Then, in the interior of a room at a temperature of 22° C. and a relative humidity of 55%, the specimen is heated in a nitrogen atmosphere from 30° C. to 250° C. at a temperature increase rate of 30° C./minute using a thermo-balance (Type TGA-50 manufactured by Shimadzu Corporation), and the loss on heating (the mass loss on heating) is measured. The water content is computed from the measured loss on heating using the following equation.

Water content (% by mass)=(loss on heating)/(mass after humidity control but before heating)×100

In the toner according to the present exemplary embodiment, the content M1 of the Si-doped strontium titanate particles and the content M2 of silica particles having an average diameter larger than the median diameter $D_{50}$ of the Si-doped strontium titanate particles may satisfy the relation $1.2 \leq M2/M1 \leq 5.0$ based on mass. When this relation is satisfied, the occurrence of fogging is further reduced.

The mass ratio of the silica particles having diameters larger than the median diameter $D_{50}$ of the Si-doped strontium titanate particles to the total mass of the silica particles is preferably from 30% by mass to 100% by mass inclusive, more preferably from 40% by mass to 100% by mass inclusive, and still more preferably from 50% by mass to 100% by mass inclusive.

The total amount of the silica particles externally added is preferably from 1 part by mass to 10 parts by mass inclusive, more preferably from 2 parts by mass to 8 parts by mass inclusive, and still more preferably from 3 parts by mass to 6 parts by mass inclusive based on 100 parts by mass of the toner particles.

[Additional External Additive]

The toner according to the present exemplary embodiment may contain an additional external additive other than the Si-doped strontium titanate particles and the silica particles, so long as the effects of the present exemplary embodiment are obtained. Examples of the additional external additive include the following inorganic and resin particles.

Examples of the additional external additive include inorganic particles. Examples of the inorganic particles include particles of $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles used as the external additive may be subjected to hydrophobic treatment. The hydrophobic treatment is performed, for example, by immersing the inorganic particles in a hydrophobic treatment agent. No particular limitation is imposed on the hydrophobic treatment agent. Examples of the hydrophobic treatment agent include silane-based coupling agents, silicone oils, titanate-based coupling agents, and aluminum-based coupling agents. These may be used alone or in combination of two or more. The amount of the hydrophobic treatment agent is generally from 1 part by mass to 10 parts by mass inclusive based on 100 parts by mass of the inorganic particles.

Other examples of the additional external additive include resin particles (particles of resins such as polystyrene, polymethyl methacrylate, and melamine resin) and a cleaning lubricant (such as particles of a fluorine-based high-molecular weight material).

When the toner according to the present exemplary embodiment contains an additional external additive, the amount of the additional external additive is preferably from 0.01% by mass to 2.0% by mass inclusive and more preferably from 0.1% by mass to 1.0% by mass inclusive based on the total mass of the toner.

[Method for Producing Toner]

The toner according to the present exemplary embodiment is obtained by externally adding the external additives to the toner particles produced.

The toner particles may be produced by a dry production method (such as a kneading-grinding method) or by a wet production method (such as an aggregation/coalescence method or a dissolution/suspension method). No particular limitation is imposed on the production method, and any known production method may be used. In particular, the aggregation/coalescence method may be used to obtain the toner particles.

Specifically, when the toner particles are produced, for example, by the aggregation/coalescence method, the toner particles are produced through: the step of preparing a resin particle dispersion in which resin particles used as the binder resin are dispersed (a resin particle dispersion preparing step); the step of aggregating the resin particles (and other optional particles) in the resin particle dispersion (the dispersion may optionally contain an additional particle dispersion mixed therein) to form aggregated particles (an aggregated particle forming step); and the step of heating the aggregated particle dispersion with the aggregated particles dispersed therein to fuse and coalesce the aggregated particles to thereby form the toner particles (a fusion/coalescence step).

These steps will next be described in detail.

In the following, a method for obtaining toner particles containing the coloring agent and the release agent will be described, but the coloring agent and the release agent are used optionally. Of course, an additional additive other than the coloring agent and the release agent may be used.

Resin Particle Dispersion Preparing Step

The resin particle dispersion in which the resin particles used as the binder resin are dispersed is prepared, and, for example, a coloring agent particle dispersion in which coloring agent particles are dispersed and a release agent particle dispersion in which release agent particles are dispersed are prepared.

The resin particle dispersion is prepared, for example, by dispersing the resin particles in a dispersion medium using a surfactant.

Examples of the dispersion medium used for the resin particle dispersion include aqueous mediums.

Examples of the aqueous medium include: water such as distilled water and ion exchanged water; and alcohols. Any of these may be used alone or in combination of two or more.

Examples of the surfactant include: anionic surfactants such as sulfate-based surfactants, sulfonate-based surfactants, phosphate-based surfactants, and soap-based surfactants; cationic surfactants such as amine salt-based surfactants and quaternary ammonium salt-based surfactants; and nonionic surfactants such as polyethylene glycol-based surfactants, alkylphenol ethylene oxide adduct-based surfactants, and polyhydric alcohol-based surfactants. Of these, an anionic surfactant or a cationic surfactant may be used. A nonionic surfactant may be used in combination with the anionic surfactant or the cationic surfactant.

Any of these surfactants may be used alone or in combination of two or more.

To disperse the resin particles in the dispersion medium to form the resin particle dispersion, a commonly used dispersing method that uses, for example, a rotary shearing-type homogenizer, a ball mill using media, a sand mill, or a dyno-mill may be used. The resin particles may be dispersed in the dispersion medium by a phase inversion emulsification method, but this depends on the type of resin particles. In the phase inversion emulsification method, the resin to be dispersed is dissolved in a hydrophobic organic solvent that can dissolve the resin, and a base is added to an organic continuous phase (O phase) to neutralize it. Then the aqueous medium (W phase) is added to change the form of the resin from W/O to O/W, and the resin is thereby dispersed as particles in the aqueous medium.

The volume average diameter of the resin particles dispersed in the resin particle dispersion is, for example, preferably from 0.01 μm to 1 μm inclusive, more preferably from 0.08 μm to 0.8 μm inclusive, and still more preferably from 0.1 μm to 0.6 μm inclusive.

The volume average particle diameter of the resin particles is measured as follows. A particle size distribution measured by a laser diffraction particle size measurement apparatus (e.g., LA-700 manufactured by HORIBA Ltd.) is used and divided into different particle diameter ranges (channels), and a cumulative volume distribution computed from the small particle diameter side is determined. The particle diameter at which the cumulative frequency is 50% is measured as the volume average particle diameter D50v. The volume average diameters of particles in other dispersions are measured in the same manner.

The content of the resin particles contained in the resin particle dispersion is preferably from 5% by mass to 50% by mass inclusive and more preferably from 10% by mass to 40% by mass inclusive.

For example, the coloring agent particle dispersion and the release agent particle dispersion are prepared in a similar manner to the resin particle dispersion. Specifically, the descriptions of the volume average diameter of the particles in the resin particle dispersion, the dispersion medium for the resin particle dispersion, the dispersing method, and the content of the resin particles are applicable to the coloring agent particles dispersed in the coloring agent particle dispersion and the release agent particles dispersed in the release agent particle dispersion.

Aggregated Particle Forming Step

Next, the resin particle dispersion, the coloring agent particle dispersion, and the release agent particle dispersion are mixed.

Then the resin particles, the coloring agent particles, and the release agent particles are hetero-aggregated in the dispersion mixture to form aggregated particles containing the resin particles, the coloring agent particles, and the release agent particles and having diameters close to the diameters of target toner particles.

Specifically, for example, a flocculant is added to the dispersion mixture, and the pH of the dispersion mixture is adjusted to acidic (for example, a pH of from 2 to 5 inclusive). Then a dispersion stabilizer is optionally added, and the resulting mixture is heated to a temperature close to the glass transition temperature of the resin particles (specifically, for example, a temperature from the glass transition temperature of the resin particles −30° C. to the glass transition temperature −10° C. inclusive) to aggregate the particles dispersed in the dispersion mixture to thereby form aggregated particles.

In the aggregated particle forming step, the flocculant may be added at room temperature (e.g., 25° C.) while the dispersion mixture is agitated, for example, in a rotary shearing-type homogenizer. Then the pH of the dispersion mixture is adjusted to acidic (e.g., a pH of from 2 to 5 inclusive), and the dispersion stabilizer is optionally added. Then the resulting mixture is heated.

Examples of the flocculant include a surfactant with a polarity opposite to the polarity of the surfactant contained in the dispersion mixture, inorganic metal salts, and divalent or higher polyvalent metal complexes. When a metal complex is used as the flocculant, the amount of the surfactant used can be reduced, and charging characteristics are improved.

The flocculant and an additive that forms a complex with a metal ion in the flocculant or a similar bond may be optionally used. The additive used may be a chelating agent.

Examples of the inorganic metal salts include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent used may be a water-soluble chelating agent. Examples of the chelating agent include: oxycarboxylic acids such as tartaric acid, citric acid, and gluconic acid; and amino carboxylic acids such as iminodiacetic acid (IDA), nitrilotriacetic acid (NTA), and ethylenediaminetetraacetic acid (EDTA).

The amount of the chelating agent added is preferably from 0.01 parts by mass to 5.0 parts by mass inclusive and more preferably 0.1 parts by mass or more and less than 3.0 parts by mass based on 100 parts by mass of the resin particles.

Fusion/Coalescence Step

Next, the aggregated particle dispersion in which the aggregated particles are dispersed is heated, for example, to a temperature equal to or higher than the glass transition temperature of the resin particles (e.g., a temperature higher by 10° C. to 30° C. than the glass transition temperature of the resin particles) to fuse and coalesce the aggregated particles to thereby form toner particles.

The toner particles are obtained through the above-described steps.

Alternatively, the toner particles may be produced through: the step of, after the preparation of the aggregated particle dispersion containing the aggregated particles dispersed therein, mixing the aggregated particle dispersion further with the resin particle dispersion containing the resin particles dispersed therein and then causing the resin particles to adhere to the surface of the aggregated particles to aggregate them to thereby form second aggregated particles; and the step of heating a second aggregated particle dispersion containing the second aggregated particles dispersed therein to fuse and coalesce the second aggregated particles to thereby form toner particles having the core-shell structure.

After completion of the fusion/coalescence step, the toner particles formed in the solution are subjected to a well-known washing step, a solid-liquid separation step, and a drying step to obtain dried toner particles. From the viewpoint of chargeability, the toner particles may be subjected to displacement washing with ion exchanged water sufficiently in the washing step. From the viewpoint of productivity, suction filtration, pressure filtration, etc. may be performed in the solid-liquid separation step. From the viewpoint of productivity, freeze-drying, flash drying, fluidized drying, vibrating fluidized drying, etc. may be performed in the drying step.

The toner according to the present exemplary embodiment is produced, for example, by adding the external additives to the dried toner particles obtained and mixing them. The mixing may be performed, for example, using a V blender, a Henschel mixer, a Loedige mixer, etc. If necessary, coarse particles in the toner may be removed using a vibrating sieving machine, an air sieving machine, etc.

<Electrostatic Image Developer>

An electrostatic image developer according to an exemplary embodiment contains at least the toner according to the preceding exemplary embodiment.

The electrostatic image developer according to the present exemplary embodiment may be a one-component developer containing only the toner according to the preceding exemplary embodiment or may be a two-component developer containing a mixture of the toner and a carrier.

No particular limitation is imposed on the carrier, and a well-known carrier may be used. Examples of the carrier include: a coated carrier prepared by coating the surface of a core material formed of a magnetic powder with a resin; a magnetic powder-dispersed carrier prepared by dispersing a magnetic powder in a matrix resin; and a resin-impregnated carrier prepared by impregnating a porous magnetic powder with a resin. In each of the magnetic powder-dispersed carrier and the resin-impregnated carrier, the particles included in the carrier may be used as a core material, and the surface of the core material may be coated with a resin.

Examples of the magnetic powder include: magnetic metal powders such as iron powder, nickel powder, and cobalt powder; and magnetic oxide powders such as ferrite powder and magnetite powder.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins having organosiloxane bonds and modified products thereof, fluorocarbon resins, polyesters, polycarbonates, phenolic resins, and epoxy resins. The coating resin and the matrix resin may contain an additional additive such as electrically conductive particles. Examples of the electrically conductive particles include: particles of metals such as gold, silver, and copper; and particles of carbon black, titanium oxide, zinc oxide, tin oxide, barium sulfate, aluminum borate, and potassium titanate.

To coat the surface of the core material with the resin, a method that uses a coating layer-forming solution prepared by dissolving the coating resin and various additives (used optionally) in an appropriate solvent may be used. No particular limitation is imposed on the solvent. The solvent may be selected in consideration of the type of the resin used, ease of coating, etc.

Specific examples of the resin coating method include: an immersion method in which the core material is immersed in the coating layer-forming solution; a spray method in which the coating layer-forming solution is sprayed onto the surface of the core material; a fluidized bed method in which the coating layer-forming solution is sprayed onto the core material floated by the flow of air; and a kneader-coater method in which the core material and the coating layer-forming solution are mixed in a kneader coater and then the solvent is removed.

The mixing ratio (mass ratio) of the toner and the carrier in the two-component developer is preferably toner:carrier=1:100 to 30:100 and more preferably 3:100 to 20:100.

<Image Forming Apparatus and Image Forming Method>

An image forming apparatus in an exemplary embodiment includes: an image holding member; charging means for charging the surface of the image holding member; electrostatic image forming means for forming an electrostatic image on the charged surface of the image holding member; developing means that contains an electrostatic image developer and develops the electrostatic image formed on the surface of the image holding member with the electrostatic image developer to thereby form a toner image; transferring means for transferring the toner image formed on the surface of the image holding member onto a recording medium; and fixing means for fixing the toner image transferred onto the recording medium. The electrostatic image developer used is the electrostatic image developer according to the preceding exemplary embodiment.

In the image forming apparatus in the present exemplary embodiment, an image forming method (an image forming method in the present exemplary embodiment) is performed. The image forming method includes: charging the surface of the image holding member; forming an electrostatic image on the charged surface of the image holding member; developing the electrostatic image formed on the surface of the image holding member with the electrostatic image developer according to the preceding exemplary embodiment to thereby form a toner image; transferring the toner image formed on the surface of the image holding member onto a recording medium; and fixing the toner image transferred onto the surface of the recording medium.

The image forming apparatus in the present exemplary embodiment may be applied to known image forming apparatuses such as: a direct transfer-type apparatus that transfers a toner image formed on the surface of the image holding member directly onto a recording medium; an intermediate transfer-type apparatus that first-transfers a toner image formed on the surface of the image holding member onto the surface of an intermediate transfer body and second-transfers the toner image transferred onto the surface of the intermediate transfer body onto the surface of a recording medium; an apparatus including cleaning means for cleaning the surface of the image holding member after the transfer of the toner image but before charging; and an apparatus including charge eliminating means for eliminating charges on the surface of the image holding member after transfer of the toner image but before charging by irradiating the surface of the image holding member with charge eliminating light.

When the image forming apparatus in the present exemplary embodiment is the intermediate transfer-type apparatus, the transferring means includes, for example: an intermediate transfer body having a surface onto which a toner image is to be transferred; first transferring means for first-transferring a toner image formed on the surface of the image holding member onto the surface of the intermediate transfer body; and second transferring means for second-transferring the toner image transferred onto the surface of the intermediate transfer body onto the surface of a recording medium.

In the image forming apparatus in the present exemplary embodiment, for example, a portion including the developing means may have a cartridge structure (process cartridge) that is detachably attached to the image forming apparatus. The process cartridge used may be, for example, a process cartridge that contains the electrostatic image developer according to the preceding exemplary embodiment and includes the developing means.

An example of the image forming apparatus in the present exemplary embodiment will be described, but this is not a limitation. In the following description, major components shown in FIG. 1 will be described, and description of other components will be omitted.

FIG. 1 a schematic configuration diagram showing the image forming apparatus in the present exemplary embodiment.

The image forming apparatus shown in FIG. 1 includes first to fourth electrophotographic image forming units 10Y, 10M, 10C, and 10K (image forming means) that output yellow (Y), magenta (M), cyan (C), and black (K) images, respectively, based on color-separated image data. These image forming units (hereinafter may be referred to simply as "units") 10Y, 10M, 10C, and 10K are arranged so as to be spaced apart from each other horizontally by a prescribed distance. These units 10Y, 10M, 10C, and 10K may each be a process cartridge detachably attached to the image forming apparatus.

An intermediate transfer belt (an example of the intermediate transfer body) 20 is disposed above the units 10Y, 10M, 10C, and 10K so as to extend through these units. The intermediate transfer belt 20 is wound around a driving roller 22 and a support roller 24 and runs in a direction from the first unit 10Y toward the fourth unit 10K. A force is applied to the support roller 24 by, for example, an unillustrated spring in a direction away from the driving roller 22, so that a tension is applied to the intermediate transfer belt 20 wound around the rollers. An intermediate transfer body cleaner 30 is disposed on an image holding member-side surface of the intermediate transfer belt 20 so as to be opposed to the driving roller 22.

Yellow, magenta, cyan, and black toners contained in toner cartridges 8Y, 8M, 8C, and 8K, respectively, are supplied to developing devices (examples of the developing means) 4Y, 4M, 4C, and 4K, respectively, of the units 10Y, 10M, 10C, and 10K.

The first to fourth units 10Y, 10M, 10C, and 10K have the same structure and operate similarly. Therefore, the first unit 10Y that is disposed upstream in the running direction of the intermediate transfer belt and forms a yellow image will be described as a representative unit.

The first unit 10Y includes a photoconductor 1Y serving as an image holding member. A charging roller (an example of the charging means) 2Y, an exposure unit (an example of the electrostatic image forming means) 3, a developing device (an example of the developing means) 4Y, a first transfer roller 5Y (an example of the first transferring means), and a photoconductor cleaner (an example of the cleaning means) 6Y are disposed around the photoconductor 1Y in this order. The charging roller charges the surface of the photoconductor 1Y to a prescribed potential, and the exposure unit 3 exposes the charged surface to a laser beam 3Y according to a color-separated image signal to thereby form an electrostatic image. The developing device 4Y supplies a charged toner to the electrostatic image to develop the electrostatic image, and the first transfer roller 5Y transfers the developed toner image onto the intermediate transfer belt 20. The photoconductor cleaner 6Y removes the toner remaining on the surface of the photoconductor 1Y after the first transfer.

The first transfer roller 5Y is disposed on the inner side of the intermediate transfer belt 20 and placed at a position opposed to the photoconductor 1Y. Bias power sources (not shown) for applying a first transfer bias are connected to the respective first transfer rollers 5Y, 5M, 5C, and 5K of the units. The bias power sources are controlled by an unillustrated controller to change the values of transfer biases applied to the respective first transfer rollers.

A yellow image formation operation in the first unit 10Y will be described.

First, before the operation, the surface of the photoconductor 1Y is charged by the charging roller 2Y to a potential of −600 V to −800 V.

The photoconductor 1Y is formed by stacking a photosensitive layer on a conductive substrate (with a volume resistivity of, for example, $1\times10^{-6}$ Ωcm or less at 20° C.). The photosensitive layer generally has a high resistance (the resistance of a general resin) but has the property that, when irradiated with a laser beam, the specific resistance of a portion irradiated with the laser beam is changed. Therefore, the charged surface of the photoconductor 1Y is irradiated with a laser beam 3Y from the exposure unit 3 according to yellow image data sent from an unillustrated controller. An electrostatic image with a yellow image pattern is thereby formed on the surface of the photoconductor 1Y.

The electrostatic image is an image formed on the surface of the photoconductor 1Y by charging and is a negative latent image formed as follows. The specific resistance of the irradiated portions of the photosensitive layer irradiated with the laser beam 3Y decreases, and this causes charges on the surface of the photoconductor 1Y to flow. However, the charges in portions not irradiated with the laser beam 3Y remain present, and the electrostatic image is thereby formed.

The electrostatic image formed on the photoconductor 1Y rotates to a prescribed developing position as the photoconductor 1Y rotates. Then the electrostatic image on the photoconductor 1Y at the developing position is developed and visualized as a toner image by the developing device 4Y.

An electrostatic image developer containing, for example, at least a yellow toner and a carrier is contained in the developing device 4Y. The yellow toner is agitated in the developing device 4Y and thereby frictionally charged. The charged yellow toner has a charge with the same polarity (negative polarity) as the charge on the photoconductor 1Y and is held on a developer roller (an example of a developer holding member). As the surface of the photoconductor 1Y passes through the developing device 4Y, the yellow toner electrostatically adheres to charge-eliminated latent image portions on the surface of the photoconductor 1Y, and the latent image is thereby developed with the yellow toner. Then the photoconductor 1Y with the yellow toner image formed thereon continues running at a prescribed speed, and the toner image developed on the photoconductor 1Y is transported to a prescribed first transfer position.

When the yellow toner image on the photoconductor 1Y is transported to the first transfer position, a first transfer bias is applied to the first transfer roller 5Y, and an electrostatic force directed from the photoconductor 1Y toward the first transfer roller 5Y acts on the toner image, so that the toner image on the photoconductor 1Y is transferred onto the intermediate transfer belt 20. The transfer bias applied in this case has a (+) polarity opposite to the (−) polarity of the toner and is controlled to, for example, +10 μA in the first unit 10Y by the controller (not shown).

The toner remaining on the photoconductor 1Y is removed and collected by the photoconductor cleaner 6Y.

The first transfer biases applied to first transfer rollers 5M, 5C, and 5K of the second unit 10M and subsequent units are controlled in the same manner as in the first unit.

The intermediate transfer belt 20 with the yellow toner image transferred thereon in the first unit 10Y is sequentially transported through the second to fourth units 10M, 10C and 10K, and toner images of respective colors are superimposed and multi-transferred.

Then the intermediate transfer belt 20 with the four color toner images multi-transferred thereon in the first to fourth units reaches a secondary transfer portion that is composed of the intermediate transfer belt 20, the support roller 24 in contact with the inner surface of the intermediate transfer belt, and a secondary transfer roller (an example of the second transferring means) 26 disposed on the image holding surface side of the intermediate transfer belt 20. A recording paper sheet (an example of the recording medium) P is supplied to a gap between the secondary transfer roller 26 and the intermediate transfer belt 20 in contact with each other at a prescribed timing through a supply mechanism, and a secondary transfer bias is applied to the support roller 24. The transfer bias applied in this case has the same polarity (−) as the polarity (−) of the toner, and an electrostatic force directed from the intermediate transfer belt 20 toward the recording paper sheet P acts on the toner image, so that the toner image on the intermediate transfer belt 20 is transferred onto the recording paper sheet P. In this case, the secondary transfer bias is determined according to a resistance detected by resistance detection means (not shown) for detecting the resistance of the secondary transfer portion and is voltage-controlled.

Then the recording paper sheet P is transported to a press contact portion (nip portion) of a pair of fixing rollers in a fixing device (an example of the fixing means) 28, and the toner image is fixed onto the recording paper sheet P to thereby form a fixed image.

Examples of the recording paper sheet P onto which a toner image is to be transferred include plain paper sheets used for electrophotographic copying machines, printers, etc. Examples of the recording medium include, in addition to the recording paper sheets P, transparencies.

To further improve the smoothness of the surface of a fixed image, it may be necessary that the surface of the recording paper sheet P be smooth. For example, coated paper prepared by coating the surface of plain paper with, for example, a resin, art paper for printing, etc. are suitably used.

The recording paper sheet P with the color image fixed thereon is transported to an ejection portion, and a series of the color image formation operations is thereby completed.

<Process Cartridge and Toner Cartridge>

A process cartridge in an exemplary embodiment includes developing means that contains the electrostatic image developer according to the preceding exemplary embodiment and develops an electrostatic image formed on the surface of an image holding member with the electrostatic image developer to thereby form a toner image. The process cartridge is detachably attached to the image forming apparatus.

The structure of the process cartridge in the present exemplary embodiment is not limited to the above described structure. The process cartridge may include, in addition to the developing means, at least one optional unit selected from other means such as an image holding member, charging means, electrostatic image forming means, and transferring means.

An example of the process cartridge in the present exemplary embodiment will be described, but this is not a limitation. In the following description, major components shown in FIG. 2 will be described, and description of other components will be omitted.

Figure 2:
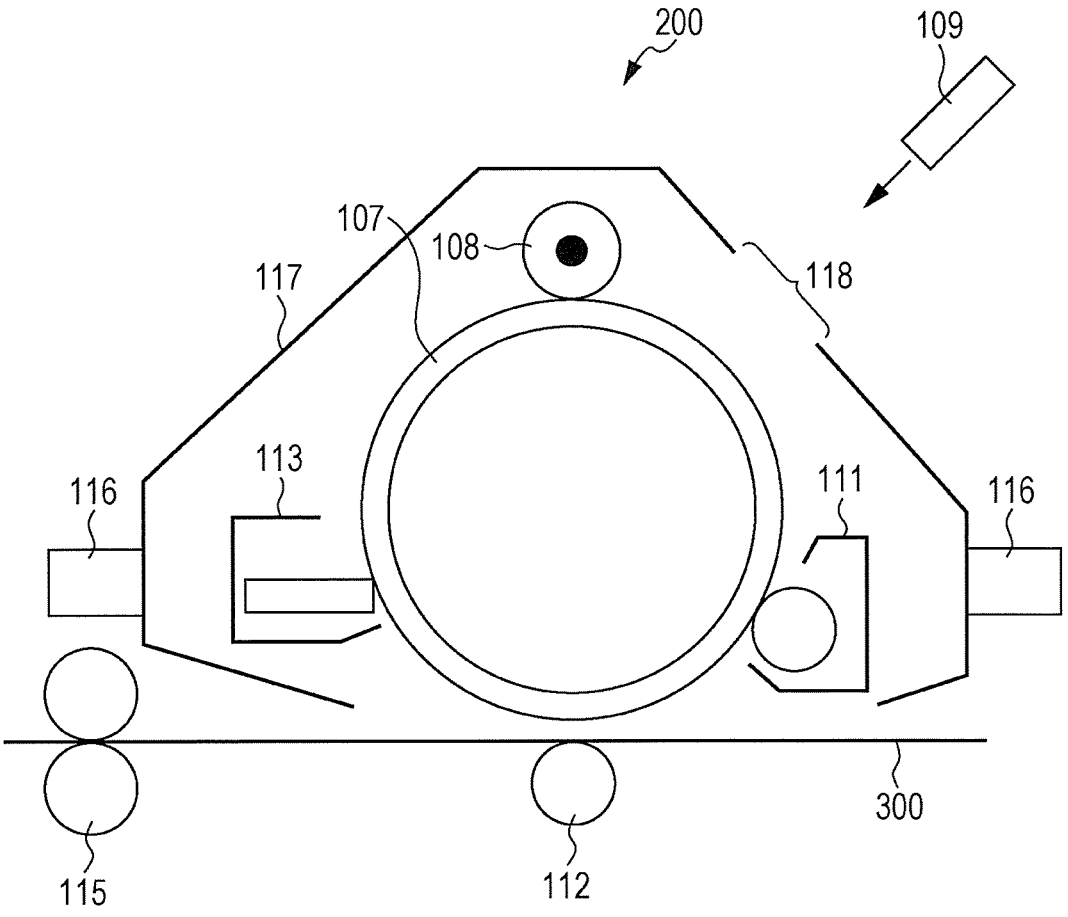
FIG. 2 is a schematic configuration diagram showing an example of a process cartridge detachably attached to the image forming apparatus according to the exemplary embodiment.

FIG. 2 is a schematic configuration diagram showing the process cartridge in the present exemplary embodiment.

The process cartridge 200 shown in FIG. 2 includes, for example, a housing 117 including mounting rails 116 and an opening 118 for light exposure and further includes a photoconductor 107 (an example of the image holding member), a charging roller 108 (an example of the charging means) disposed on the circumferential surface of the photoconductor 107, a developing device 111 (an example of the developing means), and a photoconductor cleaner 113 (an example of the cleaning means), which are integrally combined and held in the housing 117 to thereby form a cartridge.

In FIG. 2, 109 denotes an exposure unit (an example of the electrostatic image forming means), and 112 denotes a transferring device (an example of the transferring means). 115 denotes a fixing device (an example of the fixing means), and 300 denotes a recording paper sheet (an example of the recording medium).

A toner cartridge according to an exemplary embodiment contains the toner according to the preceding exemplary embodiment and is detachably attached to an image forming apparatus. The toner cartridge contains a replenishment toner to be supplied to the developing means disposed in the image forming apparatus.

The image forming apparatus shown in FIG. 1 has a structure in which the toner cartridges 8Y, 8M, 8C, and 8K are detachably attached, and the developing devices 4Y, 4M, 4C, and 4K are connected to the respective developing devices (corresponding to the respective colors) through unillustrated toner supply tubes. When the amount of the toner contained in a toner cartridge is reduced, this toner cartridge is replaced.

EXAMPLES

The exemplary embodiments of the disclosure will be described in detail by way of Examples. However, the exemplary embodiments of the disclosure are not limited to these Examples. In the following description, "parts" and are based on mass, unless otherwise specified.

<Production of Toner Particles>

[Production of Amorphous Polyester Resin Dispersion (A1)]

Terephthalic acid: 70 parts
Fumaric acid: 30 parts
Ethylene glycol: 44 parts
1,5-Pentanediol: 46 parts The above materials are placed in a flask equipped with a stirrer, a nitrogen introduction tube, a temperature sensor, and a rectifying column. The temperature of the mixture is increased to 210° C. in a nitrogen gas flow over 1 hour, and 1 part of titanium tetraethoxide is added to 100 parts of the above materials. While water produced is removed by evaporation, the temperature is increased to 240° C. over 0.5 hours. A dehydration condensation reaction is continued at 240° C. for 1 hour, and the reaction product is cooled. An amorphous polyester resin having a weight average molecular weight of 94500 and a glass transition temperature of 61° C. is thereby obtained.

A container equipped with temperature controlling means and nitrogen purging means is charged with 40 parts of ethyl acetate and 25 parts of 2-butanol to prepare a solvent mixture, and 100 parts of the amorphous polyester resin is gradually added to the solvent mixture and dissolved therein. Then a 10% aqueous ammonia solution is added thereto (in a molar amount corresponding to three times the acid value of the resin), and the mixture is stirred for 30 minutes. Next, the container is purged with dry nitrogen, and the temperature is held at 40° C. While the solution mixture is stirred, 400 parts of ion exchanged water is added dropwise to emulsify the mixture. After completion of the dropwise addition, the temperature of the emulsion is returned to 25° C., and a resin particle dispersion in which resin particles having a volume average particle diameter of 210 nm are dispersed is obtained. Ion exchanged water is added to the resin particle dispersion to adjust the solid content to 20% by mass, and an amorphous polyester resin dispersion (A1) is thereby obtained.

[Production of Crystalline Polyester Resin Dispersion (B1)]

Dimethyl sebacate: 97 parts

Dimethyl isophthalate-5-sodium sulfonate: 3 parts

Ethylene glycol: 100 parts

Dibutyl tin oxide (catalyst): 0.3 parts

The above materials are placed in a heat-dried three-neck flask. Air inside the three-neck flask is replaced with nitrogen gas to obtain an inert atmosphere, and the mixture is mechanically stirred at reflux at 180° C. for 5 hours. Next, the temperature is gradually increased to 240° C. under reduced pressure, and the mixture is stirred for 2 hours. When the mixture turns viscous, the mixture is air-cooled to stop the reaction. A crystalline polyester resin having a weight average molecular weight of 9700 and a melting temperature of 84° C. is thereby obtained.

90 Parts of the crystalline polyester resin, 1.8 parts of an anionic surfactant (NEOGEN RK manufactured by DAI-ICHI KOGYO SEIYAKU Co., Ltd.), and 210 parts of ion exchanged water are mixed, heated to 100° C., dispersed using a homogenizer (ULTRA-TURRAX T50 manufactured by IKA), and then subjected to dispersion treatment using a pressure ejection-type Gaulin homogenizer (manufactured by Gaulin Corporation) for 1 hour, and a resin particle dispersion in which resin particles having a volume average particle diameter of 205 nm are dispersed is thereby obtained. Ion exchanged water is added to the resin particle dispersion to adjust the solid content to 20% to thereby obtain a crystalline polyester resin dispersion (B1).

[Production of release agent particle dispersion (W1)]

Paraffin wax (HNP-9 manufactured by Nippon Seiro Co., Ltd.): 100 parts

Anionic surfactant (NEOGEN RK manufactured by DAI-ICHI KOGYO SEIYAKU Co., Ltd.): 1 part Ion exchanged water: 350 parts The above materials are mixed, heated to 100° C., dispersed using a homogenizer (ULTRA-TURRAX T50 manufactured by IKA), and then subjected to dispersion treatment using a pressure ejection-type Gaulin homogenizer (manufactured by Gaulin Corporation), and a release agent particle dispersion in which release agent particles having a volume average particle diameter of 200 nm are dispersed is thereby obtained. Ion exchanged water is added to the release agent particle dispersion to adjust the solid content to 20% to thereby obtain a release agent particle dispersion (W1).

[Production of Coloring Agent Particle Dispersion (K1)]

Carbon black (Regal 330 manufactured by Cabot Corporation): 50 parts

Anionic surfactant NEOGEN RK (manufactured by DAI-ICHI KOGYO SEIYAKU Co., Ltd.): 5 parts Ion exchanged water: 195 parts The above materials are mixed and subjected to dispersion treatment at 240 MPa for 10 minutes using an Ultimaizer (manufactured by Sugino Machine Limited) to thereby obtain a coloring agent particle dispersion (K1) with a solid content of 20%.

[Preparation of Toner Particles]

Ion exchanged water: 200 parts

Amorphous polyester resin dispersion (A1): 150 parts

Crystalline polyester resin dispersion (B1): 10 parts

Release agent particle dispersion (W1): 10 parts

Coloring agent particle dispersion (K1): 15 parts

Anionic surfactant (TaycaPower manufactured by Tayca Corporation): 2.8 parts

The above materials are placed in a stainless steel-made round bottom flask. 0.1N nitric acid is added thereto to adjust the pH to 3.5, and an aqueous aluminum polychloride solution prepare by dissolving 2 parts of aluminum polychloride (30% powder manufactured by Oji Paper Co., Ltd.) in 30 parts of ion exchanged water is added. The mixture is dispersed at 30° C. using a homogenizer (ULTRA-TURRAX T50 manufactured by IKA), and the resulting mixture is heated to 45° C. in a heating oil bath and held at 45° C. until the volume average particle diameter reaches 4.9 μm. Next, 60 parts of the amorphous polyester resin dispersion (A1) is added, and the mixture is held for 30 minutes. When the volume average particle diameter reaches 5.2 μm, an additional 60 parts of the amorphous polyester resin dispersion (A1) is added, and the mixture is held for 30 minutes. Next, 20 parts of a 10% aqueous NTA (nitrilotriacetic acid) metal salt solution (Chelest 70 manufactured by CHELEST CORPORATION) is added, and a 1N aqueous sodium hydroxide solution is added to adjust the pH of the mixture to 9.0. Next, 1 part of an anionic surfactant (TaycaPower) is added, and the mixture is heated to 85° C. under stirring and held for 5 hours. Then the mixture is cooled to 20° C. at a rate of 20° C./minute. The resulting mixture is filtrated, washed sufficiently with ion exchanged water, and dried, and toner particles (1) having a volume average particle diameter of 5.7 μm and an average circularity of 0.971 are thereby obtained.

<Production of Strontium Titanate Particles>

[Production of Si-Doped Strontium Titanate Particles (1)]

Metatitanic acid serving as a desulfurized and peptized titanium source is collected in an amount of 0.7 moles in terms of $TiO_2$ and placed in a reaction vessel. Next, an aqueous strontium chloride solution is added in an amount of 0.77 moles to the reaction vessel such that the molar ratio Sr/Ti is 1.1. Then a solution prepared by dissolving silicon dioxide in nitric acid is added to the reaction vessel such that the amount of Si with respect to 100 moles of strontium is 1 mole. The initial $TiO_2$ concentration in the solution mixture of these three materials is adjected to 0.75 mol/L. Then the solution mixture is stirred and heated to 90° C. While the temperature of the solution is maintained at 90° C., 153 mL of a 10N aqueous sodium hydroxide solution is added over 2 hours under stirring. Then, while the temperature of the solution is maintained at 90° C., the stirring is continued for 1 hour, and the reaction solution is cooled to 40° C. Then hydrochloric acid is added until the pH of the solution reaches 5.5, and the resulting mixture is stirred for 1 hour. Then decantation and re-dispersion in water are repeated to wash the precipitate. Hydrochloric acid is added to the slurry containing the washed precipitate to adjust the pH to 6.5. The slurry is subjected to soli-liquid separation by filtration, and the solid is dried. An ethanol solution of i-butyltrimethoxysilane is added to the dried solid such that the amount of i-butyltrimethoxysilane with respect to 100 parts of the solid is 20 parts, and the mixture is stirred for 1 hour. The mixture is subjected solid-liquid separation by filtration, and the solid is dried in air at 130° C. for 7 hours to thereby obtain Si-doped strontium titanate particles (1).

[Production of Si-Doped Strontium Titanate Particles (2) to (8)]

Si-doped strontium titanate particles (2) to (8) are produced in the same manner as in the production of the Si-doped strontium titanate particles (1) except that the amount of Si with respect to 100 moles of strontium and/or the time of dropwise addition of the 10N sodium hydroxide solution is changed as shown in Table 1.

The median diameter $D_{50}$ and the Si doping amount (the molar amount of Si with respect to the molar amount of Sr) of each of the different types of Si-doped strontium titanate particles (1) to (8) are measured by the methods described above.

[Production of Strontium Titanate Particles (9)]

Strontium titanate particles (9) are produced in the same manner as in the production of the Si-doped strontium titanate particles (1) except that no Si source is added.

TABLE 1

| Strontium titanate particles | Amount of Si added based on 100 moles of Sr (molar amount) | Time of dropwise addition of aqueous NaOH solution (hours) | Hydrophobic treatment agent | Median diameter $D_{50}$ (nm) | Si doping amount (mol %) |
|---|---|---|---|---|---|
| Si-doped $SrTiO_3$ particles (1) | 1 | 2 | i-Butyltrimethoxysilane | 42 | 1 |
| Si-doped $SrTiO_3$ particles (2) | 1 | 0.8 | i-Butyltrimethoxysilane | 30 | 1 |
| Si-doped $SrTiO_3$ particles (3) | 1 | 9 | i-Butyltrimethoxysilane | 75 | 1 |
| Si-doped $SrTiO_3$ particles (4) | 1 | 10 | i-Butyltrimethoxysilane | 85 | 1 |
| Si-doped $SrTiO_3$ particles (5) | 8 | 2 | i-Butyltrimethoxysilane | 42 | 8 |
| Si-doped $SrTiO_3$ particles (6) | 3 | 2 | i-Butyltrimethoxysilane | 42 | 3 |
| Si-doped $SrTiO_3$ particles (7) | 0.5 | 2 | i-Butyltrimethoxysilane | 42 | 0.5 |
| Si-doped $SrTiO_3$ particles (8) | 0.25 | 2 | i-Butyltrimethoxysilane | 42 | 0.25 |
| $SrTiO_3$ particles (9) | 0 | 2 | i-Butyltrimethoxysilane | 42 | 0 |

<Production of Silica Particles>

Silica particles are produced by the sol-gel method or the vapor phase method, subjected to hydrophobic treatment, and classified, if necessary, to thereby obtain silica particles shown in Table 2. The water content of sol-gel silica particles is controlled by adjusting the temperature and time of drying treatment performed after the hydrophobic treatment.

TABLE 2

| Silica particles | Granulation method | Hydrophobic treatment agent | Particle size distribution | Particle diameter of peak (nm) | Water content (%) |
|---|---|---|---|---|---|
| (1) | Sol-gel | HMDS | Monodispersed | 85 | 4 |
| (2) | Sol-gel | HMDS | Monodispersed | 85 | 1 |
| (3) | Sol-gel | HMDS | Monodispersed | 85 | 9 |
| (4) | Sol-gel | HMDS | Monodispersed | 40 | 4 |
| (5) | Sol-gel | HMDS | Monodispersed | 60 | 4 |
| (6) | Sol-gel | HMDS | Monodispersed | 110 | 4 |
| (7) | Sol-gel | HMDS | Monodispersed | 140 | 4 |
| (8) | Vapor phase method | Dimethyl silicone oil | Monodispersed | 40 | Not measured |
| (9) | Vapor phase method | Dimethyl silicone oil | Bimodal | 120 | Not measured |

In Table 2, the abbreviation "HMDS" stands for 1,1,1,3,3,3-hexamethyldisilazane. The term "monodispersed" means that the particle size distribution is unimodal and the coefficient of variation is 20% or less. In the silica particles (1) to (7) produced by the sol-gel method, the coefficient of variation of the particle size distribution is 15% or less. The particle size distribution of the silica particles (9) has a peak at 120 nm and a peak on the small-diameter side of the above peak, and the ratio of the amount of silica particles forming the peak at 120 nm is larger.

<Production of Carrier>

14 Parts of toluene, 2 parts of a styrene-methyl methacrylate copolymer (polymerization mass ratio: 90:10, weight average molecular weight: 80000), and 0.2 parts of carbon black (R330 manufactured by Cabot Corporation) are mixed and stirred for 10 minutes using a stirrer to prepare a dispersion. Next, the dispersion and 100 parts of ferrite particles (volume average particle diameter: 36 μm) are placed in a vacuum degassed-type kneader, stirred at 60° C. for 30 minutes, then heated and degassed under reduced pressure, and dried to thereby obtain a carrier.

Example 1

The Si-doped strontium titanate particles (1) and the silica particles (1) in amounts shown in Table 3 are externally added to 100 parts of the toner particles (1), and these materials are placed in a sample mill and mixed at 10000 rpm for 30 seconds. Next, the mixture is sieved using a vibrating sieve with a mesh size of 45 μm to prepare a toner having a volume average particle diameter of 5.7 μm.

The toner and the carrier are placed at a ratio of toner: carrier=5:95 (mass ratio) in a V blender and stirred for 20 minutes to thereby obtain a developer.

Examples 2 to 36 and Comparative Examples 1 to 20

Toners and developers are obtained in the same manner as in Example 1 except that the type and amount of strontium titanate particles externally added and the type and amount of silica particles externally added are changed to those shown in Tables 3 and 4.

<Performance Evaluation>

[Fogging]

A toner cartridge is filled with one of the toners in the Examples and Comparative Examples and attached to an image forming apparatus (an apparatus obtained by modifying ApeosPort-IV C5575 manufactured by Fuji Xerox Co., Ltd.). A developing device of the image forming apparatus is filled with one of the developers in the Examples and Comparative Examples.

The apparatus is left to stand in an environment at a temperature of 30° C./a relative humidity of 85% for 24 hours. Then an image with an area coverage of 1% is formed on 100000 A4-size paper sheets at intervals of 120 seconds.

Then the apparatus is left to stand in an environment at a temperature of 10° C./a relative humidity of 15% for 24 hours. Then an image with an area coverage of 40% is formed continuously on 10 A4-size paper sheets. The images on the 10 sheets are observed with the naked eye and through a loupe, and the states of fogging are classified as follows.

G1: No fogging is found in all the 10 sheets.

G2: Slight fogging is found on one sheet when the loupe is used, but the degree of fogging does not cause any problem.

G3: Slight fogging is found on a plurality of sheets when the loupe is used, but the degree of fogging is small and does not cause any practical problem.

G4: Fogging is found on a plurality of sheets with the naked eye, and the toner is not suitable for practical use.

G5: Fogging is found on all the 10 sheets with the naked eye, and the toner is not suitable for practical use.

[Cloud Amount]

The toner on an upper cover of the developing device after the image formation described above is transferred using a piece of mending tape onto a transparency, and the density on the piece of mending tape used for the transfer is measured at 8 points spaced at regular intervals using an image density meter X-Rite 938 (manufactured by X-Rite Inc.), and the difference in density between the piece of mending tape used for the transfer and a blank piece of mending tape is quantified as a cloud amount. The cloud amounts are classified using the maximum density as follows. Levels up to G3 are practically suitable.

G1: $0 \leq \Delta density \leq 0.2$

G2: $0.2 < \Delta density \leq 0.4$

G3: $0.4 < \Delta density \leq 0.6$

G4: $0.6 < \Delta density \leq 0.8$

G5: $0.8 < \Delta density$

When two or three types of silica particles are used, the "particle diameter D" in Table 3 is the diameter of a peak that is larger than the median diameter $D_{50}$ of the strontium titanate particles and closest to the median diameter $D_{50}$. Moreover, the "external addition amount M2" in Table 3 is the total external addition amount of different types of silica particles with peak diameters larger than the median diameter $D_{50}$ of the strontium titanate particles.

In Tables 3 and 4, the phrase "peak at diameter larger than median diameter $D_{50}$" means the presence or absence of a peak at a diameter larger than the median diameter $D_{50}$ of the strontium titanate particles in the particle size distribution of the silica particles.

TABLE 3

| | Strontium titanate particles | | | | Silica particles | | | | |
|---|---|---|---|---|---|---|---|---|---|
| | Type | Median diameter $D_{50}$ (nm) | Si doping amount (mol %) | External addition amount M1 (parts) | Type | Mixing ratio (mass ratio) | Particle diameter D (nm) | Water content of silica particles with diameter D (%) | Total external addition amount (parts) |
| Comparative Example 1 | (9) | 42 | 0 | 1 | (1) | | 85 | 4 | 3.5 |
| Comparative Example 2 | (9) | 42 | 0 | 1 | (2) | — | 85 | 1 | 4 |
| Comparative Example 3 | (9) | 42 | 0 | 1 | (3) | — | 85 | 9 | 3 |
| Comparative Example 4 | (9) | 42 | 0 | 1 | (4) | — | 40 | 4 | 2 |

TABLE 3-continued

| | | | | | | | | | |
|---|---|---|---|---|---|---|---|---|---|
| Comparative Example 5 | (9) | 42 | 0 | 1 | (5) | — | 60 | 4 | 2.6 |
| Comparative Example 6 | (9) | 42 | 0 | 1 | (6) | — | 110 | 4 | 4 |
| Comparative Example 7 | (9) | 42 | 0 | 1 | (7) | — | 140 | 4 | 4 |
| Comparative Example 8 | (9) | 42 | 0 | 1 | (8) | — | 40 | Not measured | 2.5 |
| Comparative Example 9 | (9) | 42 | 0 | 1 | (9) | — | 120 | Not measured | 4 |
| Example 1 | (1) | 42 | 1 | 1 | (1) | — | 85 | 4 | 3.5 |
| Example 2 | (1) | 42 | 1 | 1 | (2) | — | 85 | 1 | 4 |
| Example 3 | (1) | 42 | 1 | 1 | (3) | — | 85 | 9 | 3 |
| Comparative Example 10 | (1) | 42 | 1 | 1 | (4) | — | 40 | 4 | 2 |
| Example 4 | (1) | 42 | 1 | 1 | (5) | — | 60 | 4 | 2.6 |
| Example 5 | (1) | 42 | 1 | 1 | (6) | — | 110 | 4 | 4 |
| Example 6 | (1) | 42 | 1 | 1 | (7) | — | 140 | 4 | 4 |
| Comparative Example 11 | (1) | 42 | 1 | 1 | (8) | — | 40 | Not measured | 2.5 |
| Example 7 | (1) | 42 | 1 | 1 | (9) | — | 120 | Not measured | 4 |
| Example 8 | (1) | 42 | 1 | 1 | (1) | — | 85 | 4 | 1.1 |
| Example 9 | (1) | 42 | 1 | 1 | (1) | — | 85 | 4 | 1.3 |
| Example 10 | (1) | 42 | 1 | 1 | (1) | — | 85 | 4 | 4.8 |
| Example 11 | (1) | 42 | 1 | 1 | (1) | — | 85 | 4 | 5.2 |
| Example 12 | (1) | 42 | 1 | 1 | (1), (8) | 3:0.5 | 85 | 4 | 3.5 |
| Example 13 | (1) | 42 | 1 | 1 | (1), (8) | 1.2:2.3 | 85 | 4 | 3.5 |
| Example 14 | (1) | 42 | 1 | 1 | (1), (7) | 2.5:0.5 | 85 | 4 | 3 |
| Example 15 | (1) | 42 | 1 | 1 | (1), (7) | 1.2:1.8 | 85 | 4 | 3 |
| Example 16 | (1) | 42 | 1 | 1 | (1), (8), (9) | 2:0.5:0.5 | 85 | 4 | 3 |

| | Particle diameter | Peak at diameter larger than | External addition | Mass | Performance evaluation | |
|---|---|---|---|---|---|---|
| | difference D − $D_{50}$ (nm) | median diameter $D_{50}$ | amount M2 (parts) | ratio M2/M1 | Fogging | Cloud amount |
| Comparative Example 1 | 43 | Yes | 3.5 | 3.5 | G4 | G4 |
| Comparative Example 2 | 43 | Yes | 4 | 4.0 | G4 | G5 |
| Comparative Example 3 | 43 | Yes | 3 | 3.0 | G4 | G5 |
| Comparative Example 4 | −2 | No | 0 | 0 | G5 | G5 |
| Comparative Example 5 | 18 | Yes | 2.6 | 2.6 | G4 | G5 |
| Comparative Example 6 | 68 | Yes | 4 | 4.0 | G4 | G4 |
| Comparative Example 7 | 98 | Yes | 4 | 4.0 | G5 | G5 |
| Comparative Example 8 | −2 | No | 0 | 0 | G5 | G5 |
| Comparative Example 9 | 78 | Yes | 4 | 4.0 | G5 | G5 |
| Example 1 | 43 | Yes | 3.5 | 3.5 | G1 | G1 |
| Example 2 | 43 | Yes | 4 | 4.0 | G1 | G2 |
| Example 3 | 43 | Yes | 3 | 3.0 | G1 | G2 |
| Comparative Example 10 | −2 | No | 0 | 0 | G5 | G5 |
| Example 4 | 18 | Yes | 2.6 | 2.6 | G2 | G3 |
| Example 5 | 68 | Yes | 4 | 4.0 | G2 | G2 |
| Example 6 | 98 | Yes | 4 | 4.0 | G3 | G3 |
| Comparative Example 11 | −2 | No | 0 | 0 | G5 | G5 |
| Example 7 | 78 | Yes | 4 | 4.0 | G2 | G2 |
| Example 8 | 43 | Yes | 1.1 | 1.1 | G3 | G3 |
| Example 9 | 43 | Yes | 1.3 | 1.3 | G2 | G3 |
| Example 10 | 43 | Yes | 4.8 | 4.8 | G2 | G3 |
| Example 11 | 43 | Yes | 5.2 | 5.2 | G3 | G3 |
| Example 12 | 43 | Yes | 3 | 3.0 | G2 | G2 |
| Example 13 | 43 | Yes | 1.2 | 1.2 | G3 | G3 |
| Example 14 | 43 | Yes | 3 | 3.0 | G1 | G1 |
| Example 15 | 43 | Yes | 3 | 3.0 | G3 | G3 |
| Example 16 | 43 | Yes | 2.5 | 2.5 | G2 | G2 |

TABLE 4

| | Strontium titanate particles | | | | Silica particles | | | |
|---|---|---|---|---|---|---|---|---|
| | Type | Median diameter $D_{50}$ (nm) | Si doping amount (mol %) | External addition amount M1 (parts) | Type | Particle diameter D (nm) | Water content of silica particles with diameter D (%) | Total external addition amount (parts) |
| Example 17 | (2) | 30 | 1 | 0.8 | (1) | 85 | 4 | 3.5 |
| Example 18 | (2) | 30 | 1 | 0.8 | (5) | 60 | 4 | 4 |
| Example 19 | (2) | 30 | 1 | 0.8 | (6) | 110 | 4 | 3 |
| Example 20 | (2) | 30 | 1 | 0.8 | (7) | 140 | 4 | 3 |
| Example 21 | (2) | 30 | 1 | 0.8 | (8) | 40 | Not measured | 2.5 |
| Example 22 | (2) | 30 | 1 | 0.8 | (9) | 120 | Not measured | 3 |
| Example 23 | (3) | 75 | 1 | 1.5 | (1) | 85 | 4 | 3.5 |
| Example 24 | (3) | 75 | 1 | 1.5 | (2) | 85 | 1 | 4 |
| Example 25 | (3) | 75 | 1 | 1.5 | (3) | 85 | 9 | 3 |
| Comparative Example 12 | (3) | 75 | 1 | 1.5 | (4) | 40 | 4 | 2.5 |
| Comparative Example 13 | (3) | 75 | 1 | 1.5 | (5) | 60 | 4 | 4 |
| Example 26 | (3) | 75 | 1 | 1.5 | (6) | 110 | 4 | 3 |
| Example 27 | (3) | 75 | 1 | 1.5 | (7) | 140 | 4 | 3 |
| Comparative Example 14 | (3) | 75 | 1 | 1.5 | (8) | 40 | Not measured | 2.5 |
| Example 28 | (3) | 75 | 1 | 1.5 | (9) | 120 | Not measured | 4 |
| Comparative Example 15 | (4) | 85 | 1 | 2 | (1) | 85 | 4 | 3.5 |
| Comparative Example 16 | (4) | 85 | 1 | 2 | (2) | 85 | 1 | 4 |
| Comparative Example 17 | (4) | 85 | 1 | 2 | (3) | 85 | 9 | 3 |
| Comparative Example 18 | (4) | 85 | 1 | 2 | (4) | 40 | 4 | 2.5 |
| Comparative Example 19 | (4) | 85 | 1 | 2 | (5) | 60 | 4 | 4 |
| Example 29 | (4) | 85 | 1 | 2 | (6) | 110 | 4 | 3 |
| Example 30 | (4) | 85 | 1 | 2 | (7) | 140 | 4 | 3 |
| Comparative Example 20 | (4) | 85 | 1 | 2 | (8) | 40 | Not measured | 2.5 |
| Example 31 | (4) | 85 | 1 | 2 | (9) | 120 | Not measured | 3 |
| Example 32 | (5) | 42 | 8 | 1 | (1) | 85 | 4 | 3.5 |
| Example 33 | (6) | 42 | 3 | 1 | (1) | 85 | 4 | 3.5 |
| Example 34 | (6) | 42 | 3 | 1 | (9) | 120 | Not measured | 3 |
| Example 35 | (7) | 42 | 0.5 | 1 | (1) | 85 | 4 | 3.5 |
| Example 36 | (8) | 42 | 0.25 | 1 | (1) | 85 | 4 | 3.5 |

| | Particle diameter difference D − $D_{50}$ (nm) | Peak at diameter larger than median diameter $D_{50}$ | External addition amount M2 (parts) | Mass ratio M2/M1 | Performance evaluation Fogging | Performance evaluation Cloud amount |
|---|---|---|---|---|---|---|
| Example 17 | 55 | Yes | 3.5 | 4.4 | G2 | G2 |
| Example 18 | 30 | Yes | 4 | 5.0 | G2 | G3 |
| Example 19 | 80 | Yes | 3 | 3.8 | G2 | G3 |
| Example 20 | 110 | Yes | 3 | 3.8 | G3 | G3 |
| Example 21 | 10 | Yes | 2.5 | 3.1 | G3 | G3 |
| Example 22 | 90 | Yes | 3 | 3.8 | G3 | G3 |
| Example 23 | 10 | Yes | 3.5 | 2.3 | G3 | G3 |
| Example 24 | 10 | Yes | 4 | 2.7 | G3 | G3 |
| Example 25 | 10 | Yes | 3 | 2.0 | G3 | G3 |
| Comparative Example 12 | −35 | No | 0 | 0 | G5 | G5 |
| Comparative Example 13 | −15 | No | 0 | 0 | G5 | G5 |
| Example 26 | 35 | Yes | 3 | 2.0 | G3 | G3 |
| Example 27 | 65 | Yes | 3 | 2.0 | G3 | G3 |
| Comparative Example 14 | −35 | No | 0 | 0 | G5 | G5 |
| Example 28 | 45 | Yes | 4 | 2.7 | G3 | G3 |
| Comparative Example 15 | 0 | No | 0 | 0 | G4 | G4 |
| Comparative Example 16 | 0 | No | 0 | 0 | G5 | G4 |
| Comparative Example 17 | 0 | No | 0 | 0 | G5 | G4 |
| Comparative Example 18 | −45 | No | 0 | 0 | G5 | G5 |
| Comparative Example 19 | −25 | No | 0 | 0 | G5 | G5 |
| Example 29 | 25 | Yes | 3 | 1.5 | G3 | G3 |

TABLE 4-continued

| | | | | | | |
|---|---|---|---|---|---|---|
| Example 30 | 55 | Yes | 3 | 1.5 | G3 | G3 |
| Comparative Example 20 | −45 | No | 0 | 0 | G5 | G5 |
| Example 31 | 35 | Yes | 3 | 1.5 | G3 | G3 |
| Example 32 | 43 | Yes | 3.5 | 3.5 | G3 | G2 |
| Example 33 | 43 | Yes | 3.5 | 3.5 | G2 | G1 |
| Example 34 | 78 | Yes | 3 | 3.0 | G2 | G2 |
| Example 35 | 43 | Yes | 3.5 | 3.5 | G2 | G2 |
| Example 36 | 43 | Yes | 3.5 | 3.5 | G2 | G2 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for electrostatic image development, comprising:

toner particles;

Si-doped strontium titanate particles; and silica particles, wherein a particle diameter D of at least one peak in a number-based particle size distribution of primary particles of the silica particles is larger than a number-based median diameter $D_{50}$ of primary particles of the Si-doped strontium titanate particles.

2. The toner for electrostatic image development according to claim 1, wherein a molar amount of Si contained in the Si-doped strontium titanate particles is from 0.25 mol % to 10 mol % inclusive based on a molar amount of Sr contained in the Si-doped strontium titanate particles.

3. The toner for electrostatic image development according to claim 2, wherein the molar amount of Si contained in the Si-doped strontium titanate particles is from 1 mol % to 5 mol % inclusive based on the molar amount of Sr contained in the Si-doped strontium titanate particles.

4. The toner for electrostatic image development according to claim 1, wherein the median diameter $D_{50}$ of the Si-doped strontium titanate particles is from 30 nm to 80 nm inclusive.

5. The toner for electrostatic image development according to claim 4, wherein the median diameter $D_{50}$ of the Si-doped strontium titanate particles is from 30 nm to 60 nm inclusive.

6. The toner for electrostatic image development according to claim 1, wherein the particle diameter D of the silica particles is from 40 nm to 120 nm inclusive.

7. The toner for electrostatic image development according to claim 6, wherein the particle diameter D of the silica particles is from 60 nm to 110 nm inclusive.

8. The toner for electrostatic image development according to claim 1, wherein the median diameter $D_{50}$ of the Si-doped strontium titanate particles and the particle diameter D of the at least one peak in the number-based particle size distribution of the primary particles of the silica particles satisfy a relation represented by $10\ nm \leq D-D_{50} \leq 100\ nm$.

9. The toner for electrostatic image development according to claim 8, wherein the median diameter $D_{50}$ of the Si-doped strontium titanate particles and the particle diameter D of the at least one peak in the number-based particle size distribution of the primary particles of the silica particles satisfy a relation represented by $20\ nm \leq D-D_{50} \leq 90\ nm$.

10. The toner for electrostatic image development according to claim 1, wherein the silica particles include sol-gel silica particles, and wherein the particle diameter D of at least one peak formed by the sol-gel silica particles in the number-based particle size distribution of the primary particles of the silica particles is larger than the number-based median diameter $D_{50}$ of the primary particles of the Si-doped strontium titanate particles.

11. The toner for electrostatic image development according to claim 10, wherein the median diameter $D_{50}$ of the Si-doped strontium titanate particles and the particle diameter D of the at least one peak formed by the sol-gel silica particles satisfy a relation represented by $10\ nm \leq D-D_{50} \leq 100\ nm$.

12. The toner for electrostatic image development according to claim 10, wherein a water content of the sol-gel silica particles is from 1% by mass to 10% by mass inclusive.

13. The toner for electrostatic image development according to claim 1, wherein a content M1 of the Si-doped strontium titanate particles and a content M2 of silica particles having an average diameter larger than the median diameter $D_{50}$ of the Si-doped strontium titanate particles satisfy a relation represented by $1.2 \leq M2/M1 \leq 5.0$ based on mass.

14. An electrostatic image developer comprising the toner for electrostatic image development according to claim 1.

15. A toner cartridge containing the toner for electrostatic image development according to claim 1, the toner cartridge being detachably attached to an image forming apparatus.

* * * * *